US011149613B2

(12) United States Patent
Bhargava et al.

(10) Patent No.: US 11,149,613 B2
(45) Date of Patent: Oct. 19, 2021

(54) EXHAUST GAS TREATMENT ARTICLE AND METHODS OF MANUFACTURING SAME

(71) Applicant: Corning Incorporated, Corning, NY (US)

(72) Inventors: Rajesh Yogesh Bhargava, Painted Post, NY (US); Dana Craig Bookbinder, Corning, NY (US); Curtis Richard Cowles, Corning, NY (US); Jacob George, Horseheads, NY (US); Jason Thomas Harris, Horseheads, NY (US); Seth Thomas Nickerson, Corning, NY (US); Pushkar Tandon, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 73 days.

(21) Appl. No.: 16/316,906

(22) PCT Filed: Jul. 13, 2017

(86) PCT No.: PCT/US2017/041918
§ 371 (c)(1),
(2) Date: Jan. 10, 2019

(87) PCT Pub. No.: WO2018/013800
PCT Pub. Date: Jan. 18, 2018

(65) Prior Publication Data

US 2019/0162097 A1 May 30, 2019

Related U.S. Application Data

(60) Provisional application No. 62/361,829, filed on Jul. 13, 2016.

(51) Int. Cl.
*F01N 3/28* (2006.01)
*F01N 13/18* (2010.01)

(52) U.S. Cl.
CPC ..... *F01N 3/2878* (2013.01); *F01N 3/2825* (2013.01); *F01N 3/2828* (2013.01);
(Continued)

(58) Field of Classification Search
None
See application file for complete search history.

(56) References Cited

U.S. PATENT DOCUMENTS 3,906,782 A 9/1975 Early et al.
4,810,554 A 3/1989 Hattori et al.
(Continued)

FOREIGN PATENT DOCUMENTS

CA 1289544 C 9/1991
EP 0837229 A1 4/1998
(Continued)

OTHER PUBLICATIONS

Gulati et al; "Isostatic Strength of Porous Cordierite Ceramic Monoliths" ; SAE Technical Paper Series; 910375; 1991; 13 Pages.
(Continued)

*Primary Examiner* — Humera N. Sheikh
*Assistant Examiner* — Mary I Omori
(74) *Attorney, Agent, or Firm* — Kurt R. Denniston

(57) ABSTRACT

Exhaust gas treatment articles and methods of manufacturing the same are disclosed herein. An exhaust gas treatment article includes a porous ceramic honeycomb body with multiple channel walls defining cell channels that extend in an axial direction and an outer peripheral surface that extends in the axial direction. The exhaust gas treatment article further includes a metal layer that surrounds the porous ceramic honeycomb body and that is in direct contact with at least a portion of the outer peripheral surface of the porous ceramic honeycomb body. The metal layer includes a joint. The exhaust gas treatment article includes a shim that
(Continued)

is located under the joint and that is in direct contact with at least a portion of the outer peripheral surface of the porous ceramic honeycomb body.

19 Claims, 17 Drawing Sheets

(52) U.S. Cl.
CPC ..... *F01N 3/2839* (2013.01); *F01N 3/2842* (2013.01); *F01N 13/185* (2013.01); *F01N 13/1844* (2013.01); *F01N 13/1861* (2013.01); *F01N 2330/06* (2013.01); *F01N 2350/02* (2013.01); *F01N 2450/02* (2013.01); *F01N 2450/22* (2013.01)

(56) References Cited

U.S. PATENT DOCUMENTS

| | | | | |
|---|---|---|---|---|
| 5,079,210 | A | 1/1992 | Kaji et al. | |
| 5,329,698 | A | 7/1994 | Abbott | |
| 5,376,341 | A | 12/1994 | Gulati | |
| 5,849,251 | A * | 12/1998 | Timko | F01N 3/28 422/177 |
| 5,943,771 | A | 8/1999 | Schmitt | |
| 6,000,131 | A | 12/1999 | Schmitt | |
| 6,521,193 | B1 | 2/2003 | Hijikata et al. | |
| 6,673,320 | B1 | 1/2004 | Tosa et al. | |
| 7,727,613 | B2 | 6/2010 | Suwabe et al. | |
| 8,997,352 | B2 | 4/2015 | Troeger et al. | |
| 10,017,311 | B2 | 7/2018 | Bookbinder et al. | |
| 10,151,230 | B2 | 12/2018 | Bookbinder et al. | |
| 2004/0170541 | A1 | 9/2004 | Flehmig et al. | |
| 2005/0169819 | A1 | 8/2005 | Shibata | |
| 2006/0027630 | A1 * | 2/2006 | Talwar | B23K 20/128 228/112.1 |
| 2008/0053080 | A1 | 3/2008 | Faust et al. | |
| 2013/0212051 | A1 | 8/2013 | Stephens, II et al. | |
| 2016/0348552 | A1 * | 12/2016 | Hatakeyama | B01D 53/9454 |
| 2018/0073410 | A1 | 3/2018 | Bookbinder et al. | |

FOREIGN PATENT DOCUMENTS

| | | | |
|---|---|---|---|
| EP | 1101911 | B1 | 12/2004 |
| EP | 2077155 | A2 | 7/2009 |
| JP | 2000064832 | A | 2/2000 |
| WO | 2011034015 | A1 | 3/2011 |
| WO | 2011/088852 | A1 | 7/2011 |
| WO | 2016/153955 | A1 | 9/2016 |

OTHER PUBLICATIONS

Gulati et al; "Measurement of Biaxial Compressive Strength of Cordierite Ceramic Honeycombs" ; SAE Technical Paper Series; 930165; 1993; 13 Pages.

Gulati et al; "New Developments in Packaging of Ceramic Honeycomb Catalysts" ; SAE Technical Paper Series 922252; 1992; 11 Pages.

International A1:A22Search Report and Written Opinion of the International Searching Aurthority; PCT/US2017/041918; dated Sep. 12, 2017; 11 Pages; European Patent Office.

* cited by examiner

EXHAUST GAS TREATMENT ARTICLE AND METHODS OF MANUFACTURING SAME

This application is a National Stage application under 35 U.S.C. § 371 of International Application No. PCT/US2017/041918, filed on Jul. 13, 2017, which claims the benefit of priority to U.S. Provisional Application No. 62/361,829, filed Jul. 13, 2016, the contents of which are incorporated herein by reference in their entireties.

FIELD

Exemplary embodiments of the present disclosure relate to exhaust gas treatment articles and methods of manufacturing the same.

BACKGROUND

After-treatment of exhaust gas from internal combustion engines may use catalysts supported on high-surface area substrates and, in the case of diesel engines and some gasoline direct injection engines, a catalyzed or non-catalyzed filter for the removal of carbon soot particles. Porous ceramic flow-through honeycomb substrates and wall-flow honeycomb filters may be used in these applications.

SUMMARY

Illustrative embodiments of the present disclosure are directed to an exhaust gas treatment article. The exhaust gas treatment article comprises a porous ceramic honeycomb body with (i) a number of channel walls defining cell channels that extend in an axial direction between a first end face and a second end face of the porous ceramic honeycomb body, and (ii) an outer peripheral surface that extends in the axial direction between the first end face and the second end face. The exhaust gas treatment article further comprises a metal layer that surrounds the porous ceramic honeycomb body and that is in direct contact with at least a portion of the outer peripheral surface of the porous ceramic honeycomb body. The metal layer includes a joint, such as a welded joint that extends in the axial direction. The exhaust gas treatment article also includes a shim that is located under the joint and that is in direct contact with at least a portion of the outer peripheral surface of the porous ceramic honeycomb body.

In various embodiments, the article does not include a mat between the metal layer and the outer peripheral surface of the porous ceramic honeycomb body.

In some embodiments, greater than 50% of the outer peripheral surface of the porous ceramic honeycomb body is in direct contact with the metal layer. In various embodiments, the metal layer is shrink-fit to the porous ceramic article and applies a compressive radial force to the outer peripheral surface of the porous ceramic honeycomb body.

In some embodiments, the shim includes a metal material. The shim may have a smaller thickness than the metal layer. Also, the shim may include one or more tapered ends. The shim may also include a plurality of shims comprising ends. Some of the ends of the shims may be offset from one another (e.g., at least one of the ends of two shims of the plurality of shims are offset from one another).

In some embodiments, the exhaust gas treatment article includes a pair of ribs located on the metal layer and that extend around a circumference of the metal layer. The pair of ribs may be located on an outer surface of the metal layer. Additionally or alternatively, the pair of ribs may be located on an inner surface of the metal layer. In various embodiments, the pair of ribs is located on portions of the metal layer that are spaced from the porous ceramic honeycomb body with respect to the axial direction.

Illustrative embodiments of the present disclosure are also directed to a method of manufacturing an exhaust gas treatment article. The exhaust gas treatment article comprises a porous ceramic honeycomb body with (i) a plurality of channel walls defining cell channels that extend in an axial direction between first and second end faces and (ii) an outer peripheral surface that extends in the axial direction between first and second end faces. The method includes shrink-fitting a metal layer with a joint onto a shim and the porous ceramic honeycomb article such that (i) the metal layer surrounds the porous ceramic honeycomb body, (ii) the shim is located under the joint, and (iii) the shim is located between the metal layer and the porous ceramic honeycomb body.

In various embodiments, the metal layer is in direct contact with a portion of the outer peripheral surface of the porous ceramic honeycomb body.

The method may further comprise joining a first portion of the metal layer to a second portion of the metal layer to form the joint by, for example, welding the first portion and the second portion together.

In some embodiments, the shrink-fitting process includes heating the metal layer to a temperature greater than or equal to 200° C.

In further embodiments, the shrink-fitting process includes tightening the metal layer around the honeycomb body while the metal layer has a temperature greater than or equal to about 200° C.

In various embodiments, the shrink-fitting process includes allowing the metal layer to cool while the shim and porous ceramic honeycomb body are surrounded by the metal layer.

It is to be understood that both the foregoing general description and the following detailed description are exemplary and explanatory and are intended to provide further explanation of the disclosure.

BRIEF DESCRIPTION OF THE FIGURES

The accompanying drawings, which are included to provide a further understanding of the disclosure and are incorporated in and constitute a part of this specification, illustrate exemplary embodiments of the disclosure, and together with the description serve to explain the principles of the disclosure.

DETAILED DESCRIPTION

Figure 1A:
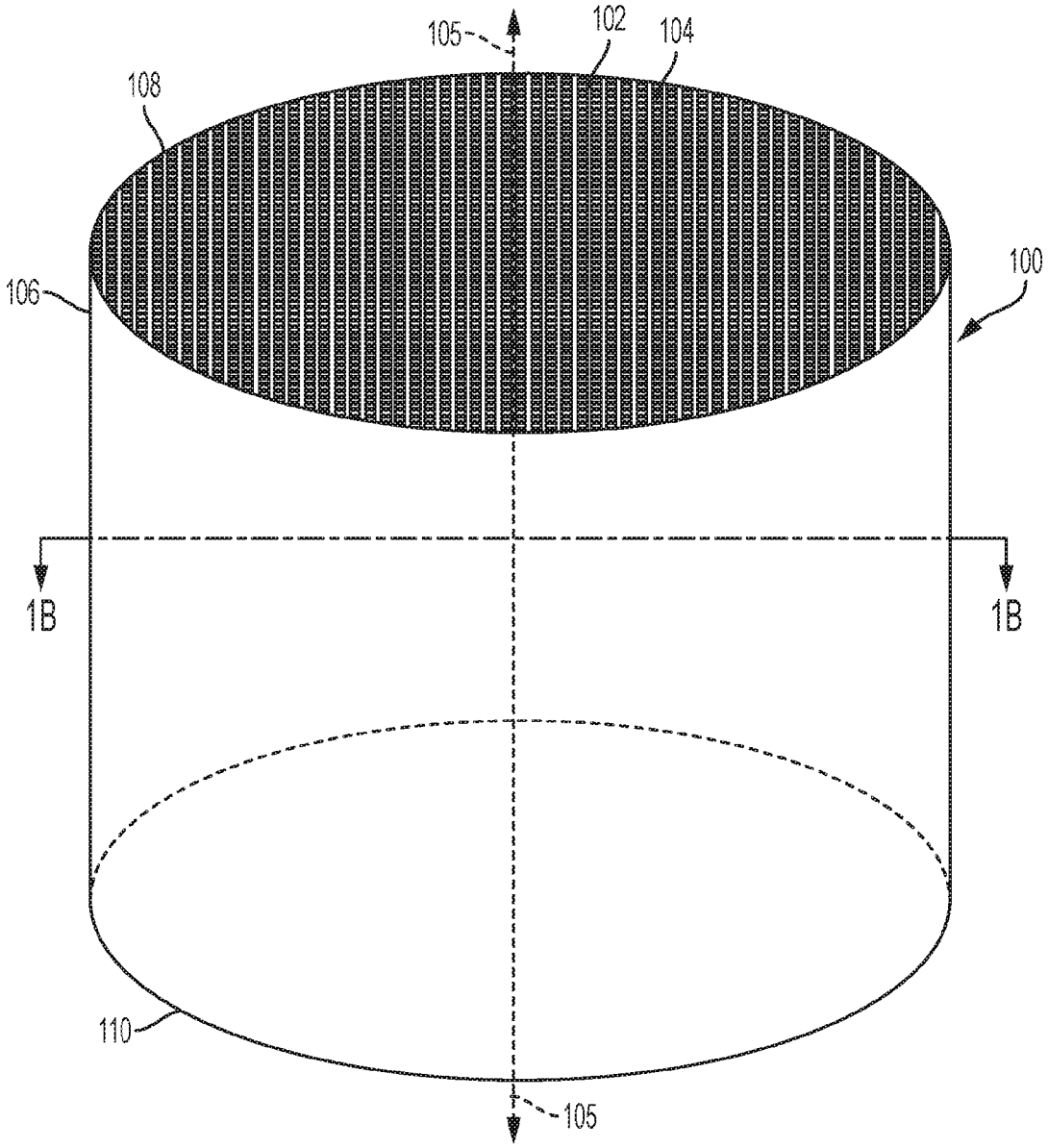
Figure 1A PRIOR ART
FIG. 1A shows a perspective view showing an example of a porous ceramic honeycomb body.

The disclosure is described more fully hereinafter with reference to the accompanying drawings, in which exemplary embodiments of the disclosure are shown. This disclosure may, however, be embodied in many different forms and should not be construed as limited to the exemplary embodiments set forth herein. Rather, these embodiments are provided so that this disclosure is thorough, and will fully convey the scope of the disclosure to those skilled in the art. In the drawings, the size and relative sizes of layers and regions may be exaggerated for clarity.

It will be understood that when an element or layer is referred to as being "on", "connected to", "in contact with," "or "adjacent to" another element or layer, it can be directly on, directly connected to, in direct contact with, or directly adjacent to the other element or layer, or intervening elements or layers may be present. In contrast, when an element or layer is referred to as being "directly on", "directly connected to", "in direct contact with" or "directly adjacent to" another element or layer, there are no intervening elements or layers present. Like reference numerals in the drawings denote like elements. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

While terms such as, top, bottom, side, upper, lower, vertical, and horizontal are used, the disclosure is not so limited to these exemplary embodiments. Instead, spatially relative terms, such as "top", "bottom", "horizontal", "vertical", "side", "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" modifying, for example, the quantity of an ingredient in a composition, concentrations, volumes, process temperature, process time, yields, flow rates, pressures, viscosities, and like values, and ranges thereof, employed in describing the embodiments of the disclosure, refers to variation in the numerical quantity that can occur, for example: through typical measuring and handling procedures used for preparing materials, compositions, composites, concentrates, or use formulations; through inadvertent error in these procedures; through differences in the manufacture, source, or purity of starting materials or ingredients used to carry out the methods; and like considerations. The term "about" also encompasses amounts that differ due to aging of a composition or formulation with a particular initial concentration or mixture, and amounts that differ due to mixing or processing a composition or formulation with a particular initial concentration or mixture.

In these exemplary embodiments, the disclosed exhaust gas treatment article, and the disclosed method of making the article provide one or more advantageous features or aspects, including for example as discussed below. Features or aspects recited in any of the claims are generally applicable to all facets of the disclosure. Any recited single or multiple feature or aspect in any one claim can be combined or permuted with any other recited feature or aspect in any other claim or claims.

Automotive catalytic converter honeycomb substrates and diesel particulate filters (e.g., Celcor® and DuraTrap® honeycombs) include a porous ceramic honeycomb body. The porous ceramic honeycomb bodies are used to catalyze and/or filter exhaust gas that flows through the bodies. FIG. 1A is a perspective view showing an example of a porous ceramic honeycomb body 100. The porous ceramic honeycomb body 100 includes multiple channel walls 102 defining cell channels 104 that extend in an axial direction 105 between a first end face 108 and second end face 110 of the body. The body 100 also includes an outer peripheral surface 106 that extends in the axial direction 105 between the end faces 108, 110 of the body. In some embodiments, the honeycomb body 100 includes plugs at the ends of alternate channels, which can block and direct exhaust gas flow through the channels and force the exhaust gas through the porous channel walls of the honeycombs before exiting the body. In this manner the porous ceramic honeycomb body can filter and/or catalyze exhaust gasses.

The porous ceramic honeycomb body is mounted inside a metal housing that is also referred to as a "can". The can includes one or more metal layers that surround the porous ceramic honeycomb body. The porous ceramic honeycomb body is secured inside the can so that the entire article can be mounted (e.g., by welding) inside an exhaust system.

Figure 1B:
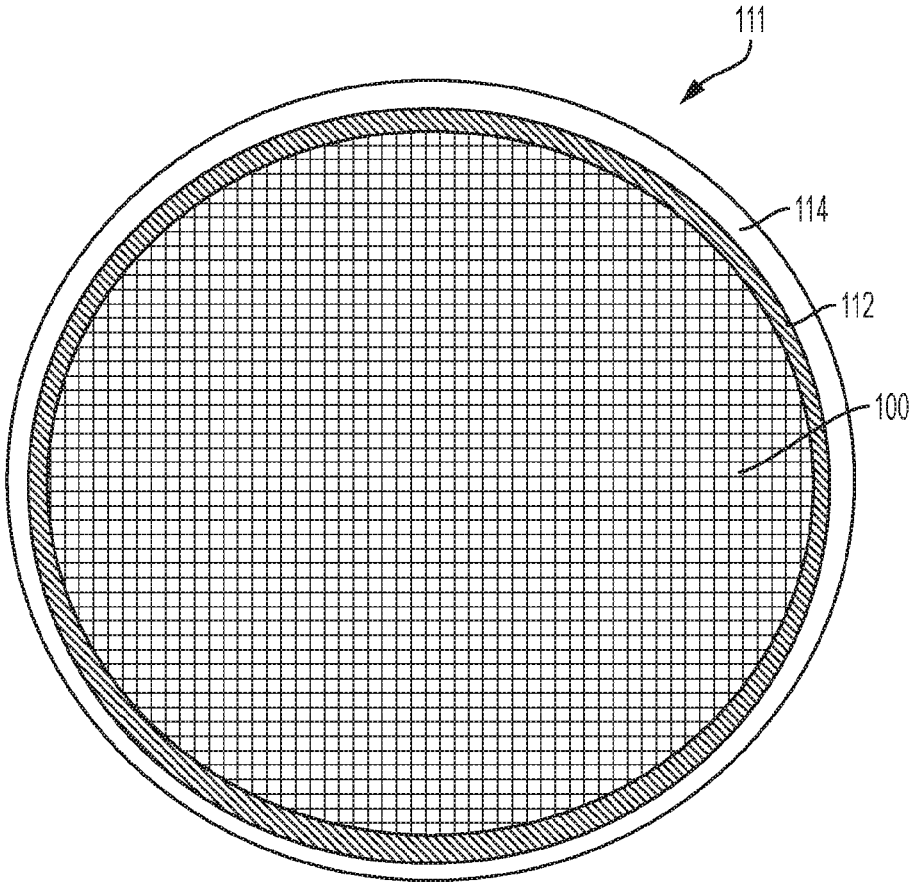
Figure 1B PRIOR ART
FIG. 1B shows a schematic sectional view showing the honeycomb body along line 1B-1B of FIG. 1A.

During installation of the porous ceramic honeycomb body into a can, a compliant, compressible fiber blanket (i.e. "mat") is placed around the body to minimize the effects of vibration and to apply a uniform, controlled contact pressure on the body. FIG. 1B is a schematic sectional view showing the honeycomb body 100 along line 1B-1B of FIG. 1A. In addition to the honeycomb body 100, FIG. 1B also shows an exhaust gas treatment article 111 where the mat 112 extends around a circumference of the body 100 and a metal layer 114 (forming the can) extends around and surrounds the body and the mat.

As the exhaust treatment article 111 becomes hot and the metal layer expands in diameter and length, the mat 112 acts as a compliant interface or buffer, expanding and compressing to accommodate the space between the body 100 and the metal layer 114, thereby protecting the body from movement. During long-term usage, temperature cycling and vibration can break down the integrity of the mat 112.

Some of the current mats being used in exhaust gas treatment articles are expensive components. For example, some current mats may cost almost as much as the honeycomb body (e.g., substrate or filter) itself. The worldwide market for mats is greater than $500 million per year. There are potential problems associated with mat decomposition and fibers from the mat plugging downstream parts of exhaust systems.

Novel and low cost methods for mounting honeycomb bodies in a metal can using shrink-fitting without use of any mat material have been disclosed recently in PCT Application No. WO 2016/153955, published on Sep. 29, 2016, and entitled "Exhaust Gas Treatment Article and Methods of Manufacturing Same," which is hereby incorporated by reference in its entirety. A shrink-fitting process heats a first component (e.g., a metal can) causing the first component to expand so that a second component (e.g., a honeycomb body) can be fit within the first component. As the first component cools, the first component shrinks and secures the second component within the first component. One potential problem with shrink-fitting is that a portion of the metal can that is unconstrained by the honeycomb body may produce point loading of the honeycomb body during the shrink-fitting process and/or field operation, particularly at edges located at the end faces of the body, resulting in catastrophic failure of the canned article.

Methods for reducing point loading of shrink-fit canned exhaust treatment articles are disclosed herein. Various embodiments of the methods mitigate issues with honeycomb body cracking associated with point loading of the body near the end faces of the body. Shrink-fit canning processes and designs can result in pressure concentration loading at edges of the honeycomb body. This disclosure provides several embodiments which significantly reduce this pressure point and, in turn, reduce premature product failures. One solution is to include internal rib features ("retainer rings") on an inner surface of a metal layer forming the can. Another solution is to include external rib features on an outer surface of a metal layer from the can ("flanging"). The internal and external ribs can have different thermal expansion coefficients from the metal layers forming the can. Also, the internal and external rib features can serve to reinforce the metal layer and protect the edges of the honeycomb bodies. Modeling and experimental results for the solutions are provided below.

Figure 2A:
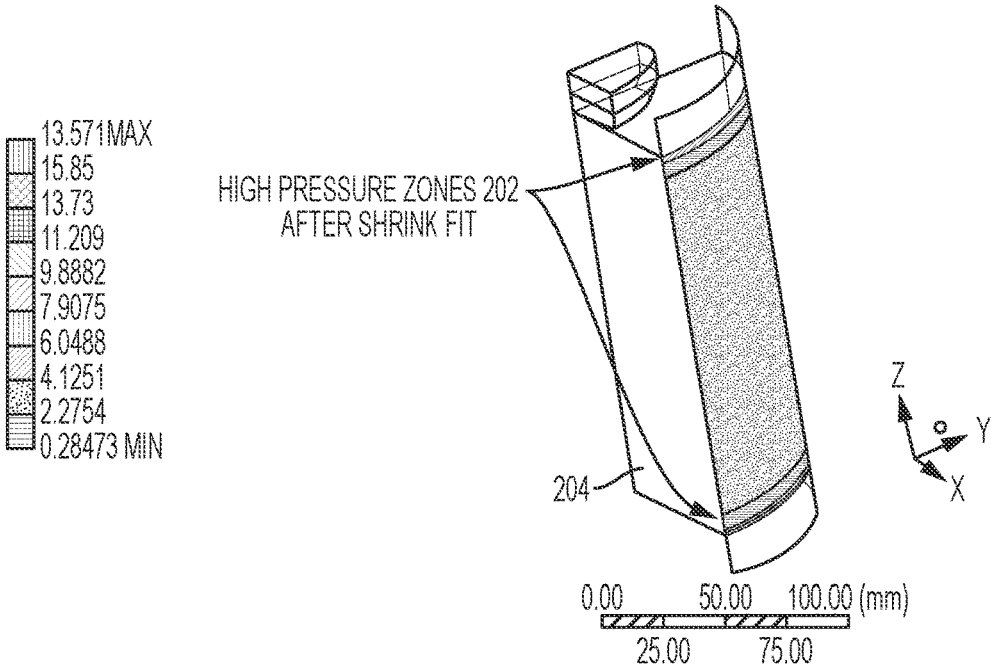
FIG. 2A shows a contact pressure contour with high pressures at ends of a honeycomb body in an arrangement where the honeycomb body is disposed in a can without a mat.
Figure 2B:
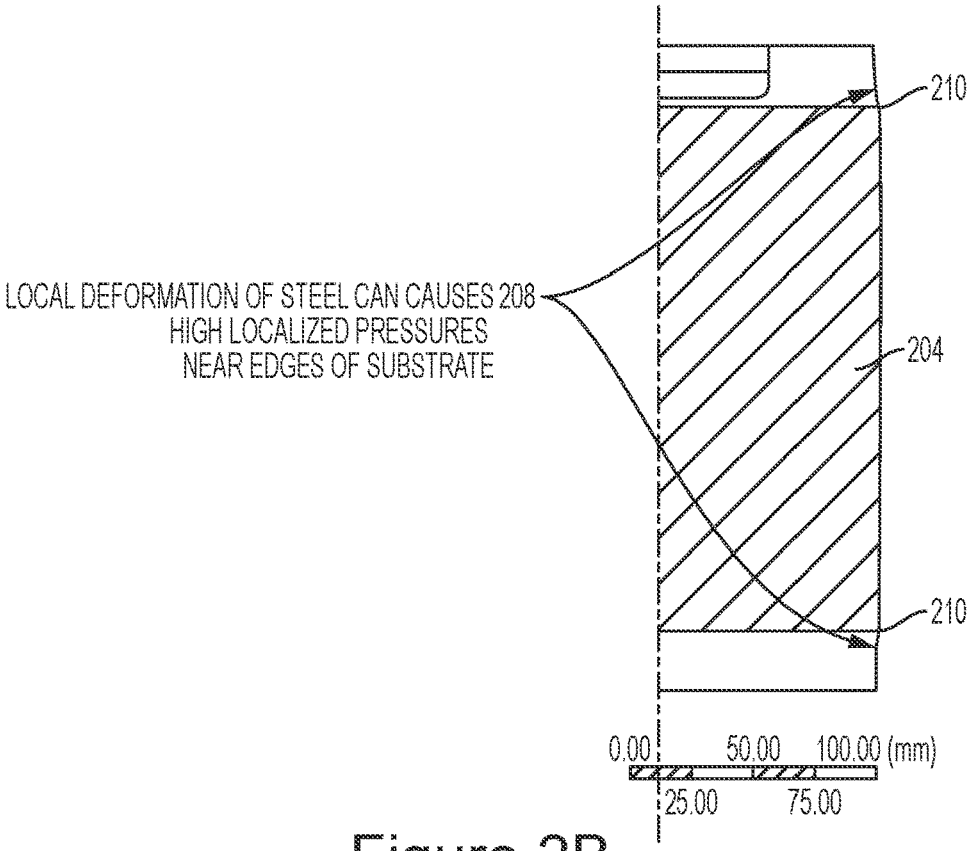
FIG. 2B shows a schematic sectional view of deformation in a can with a porous ceramic honeycomb body disposed within the can without a mat.

A shrink-fit canning process can result in high localized pressure near the ends of a porous ceramic honeycomb body (e.g. substrates or diesel particulate filters (DPFs)). FIG. 2A shows a contact pressure contour with high pressures at edges 202 of a honeycomb body 204 for an arrangement where the honeycomb body is shrink-fit canned without a mat. FIG. 2B shows a schematic sectional view of deformation for a can with a porous ceramic honeycomb body disposed within the can without a mat. FIG. 2B shows that deformation 208 of the metal can creates high contact pressures near the edges 210 of the honeycomb body. FIGS. 2A and 2B were generated using computer simulations. This mechanism of high pressure is found very clearly in the simulations and is not an obvious mechanism of action due to the inherent three-dimensional nature of the deformations.

More specifically, these local pressure points are not predicted by a two-dimensional shrink-fit elasticity analysis because of the inherent three-dimensional nature of the deformations. Additionally, the magnitude of this pressure point is large. For the examples shown, the peak pressures were approximately five to seven times that of the nominal average contact pressure. Such peak pressure can cause premature honeycomb body failures.

Figure 3:
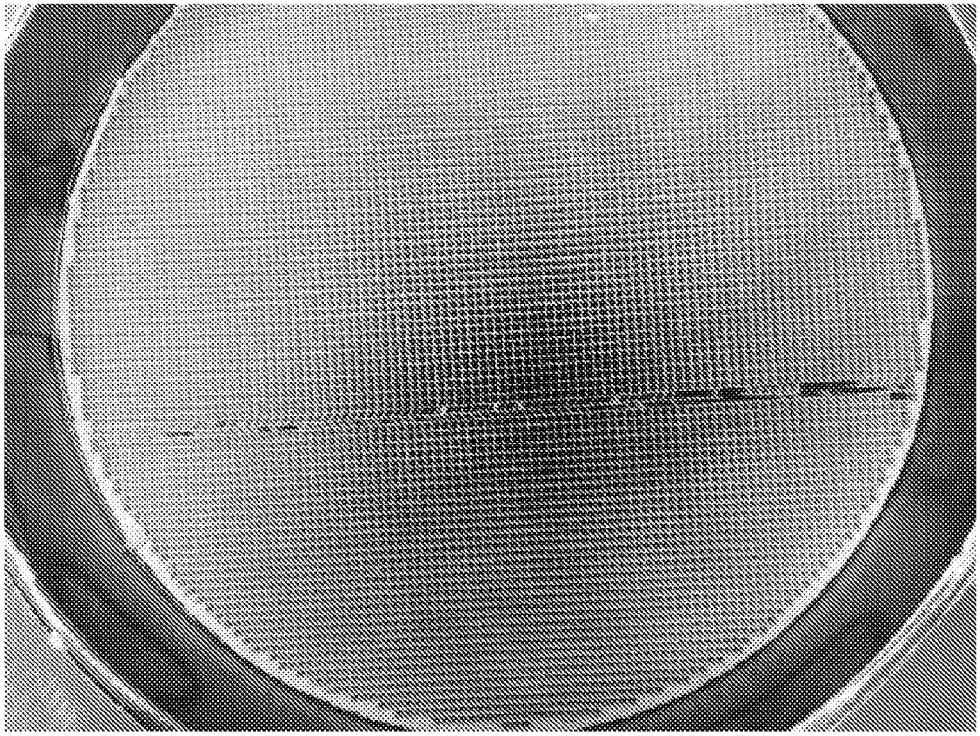
FIG. 3 shows a photograph of an example of a honeycomb body failure during a shrink-fit process.

Premature honeycomb body failures during the shrink-fit process were experimentally observed as well. FIG. 3 presents a photograph of an example of a honeycomb body failure during a shrink-fitting process. After identifying the problem, a model was created to help study potential solutions for reducing localized pressure loading. Specifically, the proposed solution is to use a rib located on a metal layer forming the can and around the circumference of the metal layer to reinforce and reduce pressures in this local region. The rib forms a ring around the circumference of the metal layer (e.g., a "retainer ring" or "flange"). Simulations were performed to analyze the effects of the rib reinforcement in configurations on both the inside and the outside of the metal layer. The rib has been added in order to prevent crushing of the edges of the honeycomb body as previously described, which is due to the unconstrained deformation of the ends of the can.

Figure 4A:
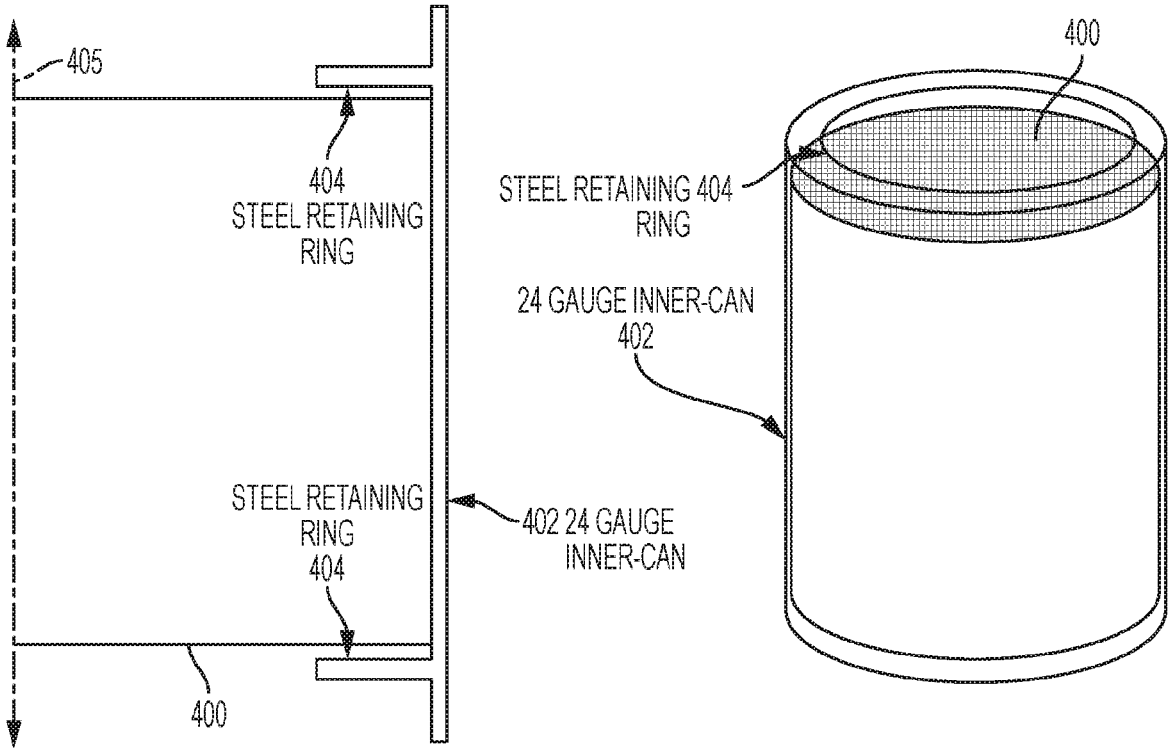
FIG. 4A shows a schematic sectional view (on the left) and a perspective view (on the right) of a honeycomb body disposed in a can having ribs in accordance one embodiment of the present disclosure.
Figure 4B:
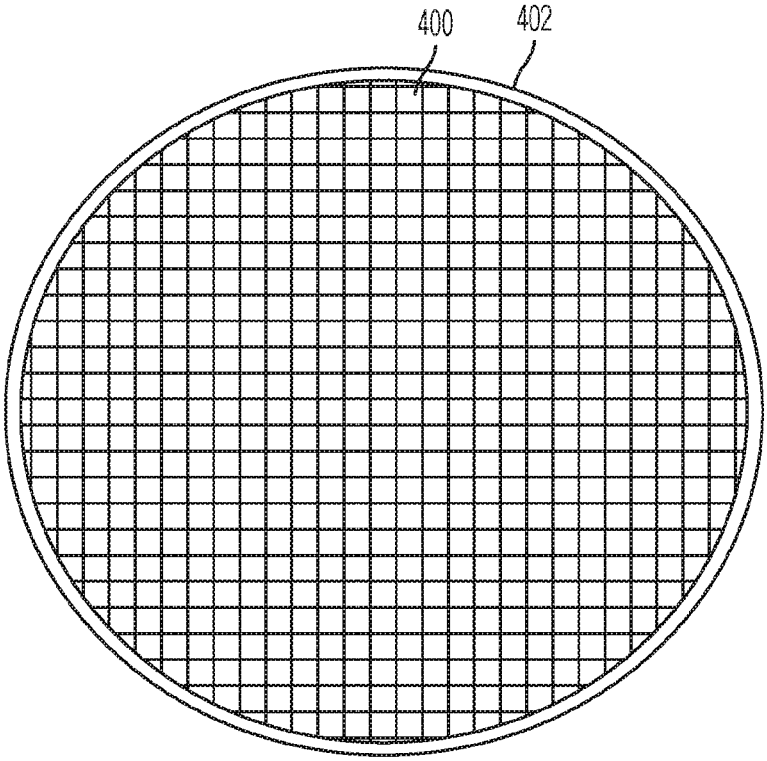
FIG. 4B shows a schematic sectional view showing the honeycomb body and the can along line 4B-4B of FIG. 4A.
Figure 5:
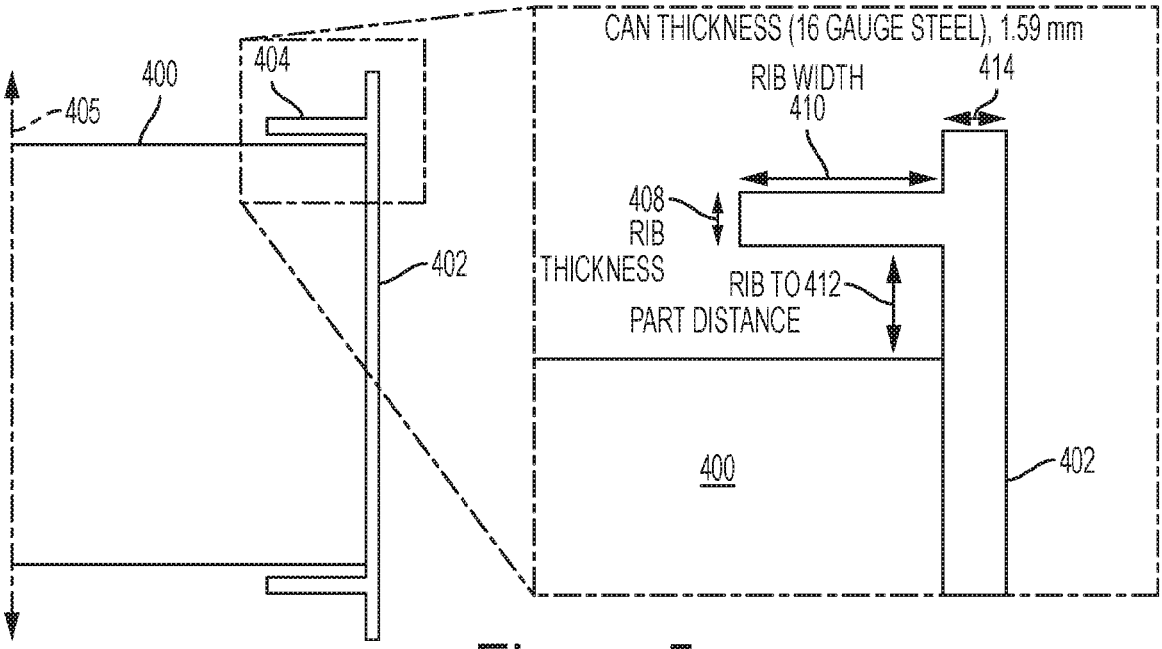
FIG. 5 shows a schematic sectional view (on the left) and a detailed view (on the right) of a honeycomb body disposed in a can having ribs in accordance one embodiment of the present disclosure.
Figure 8:
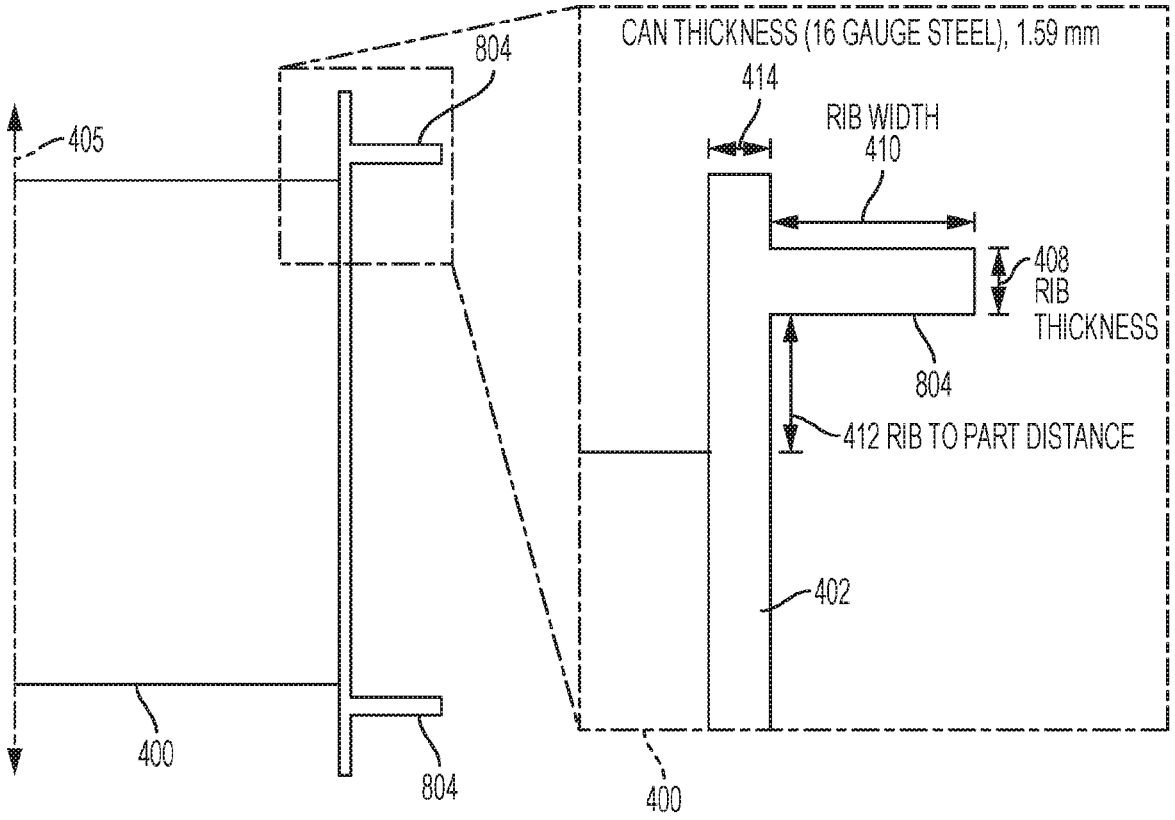
FIG. 8 shows a rib design where a rib is located on an outer surface of a metal layer in accordance one embodiment of the present disclosure.

Two different embodiments of the disclosure are shown in FIGS. 4A and 8. FIG. 4A presents a schematic cross sectional view (on the left) and a perspective view (on the right) of a honeycomb body 400 surrounded by a metal layer 402 (forming a can) without a mat disposed between the body and the metal layer. FIG. 4B is a schematic sectional view showing the honeycomb body 400 and the metal layer 402 along line 4B-4B of FIG. 4A. A pair of ribs 404 is located on an inner surface of the metal layer 402. The pair of ribs 404 extends around a circumference of the metal layer 402 to form a pair of rings. In FIGS. 4A, 5, and 8, broken line 405 extends in an axial direction and represents a centerline of the honeycomb body 402.

FIG. 5 presents a schematic sectional view of a honeycomb body 400 surrounded by a metal layer 402 (forming a can) without a mat disposed between the honeycomb body and the metal layer. The pair of ribs 404 is located on portions of the metal layer 402 that are spaced from the porous ceramic honeycomb body 400 with respect to an axial direction 405. FIG. 5 identifies various different rib parameters, including rib thickness 408, rib width 410, and axial distance 412 between the rib and the porous honeycomb ceramic body 400 (excluding applied temperatures and material properties). In FIG. 5, the metal layer 402 had a thickness 414 of 1.59 mm. The metal layer was formed from steel with 16 gauge thickness. The rib thickness and axial distance were primary factors of the simulations, as described below.

Figure 6A:
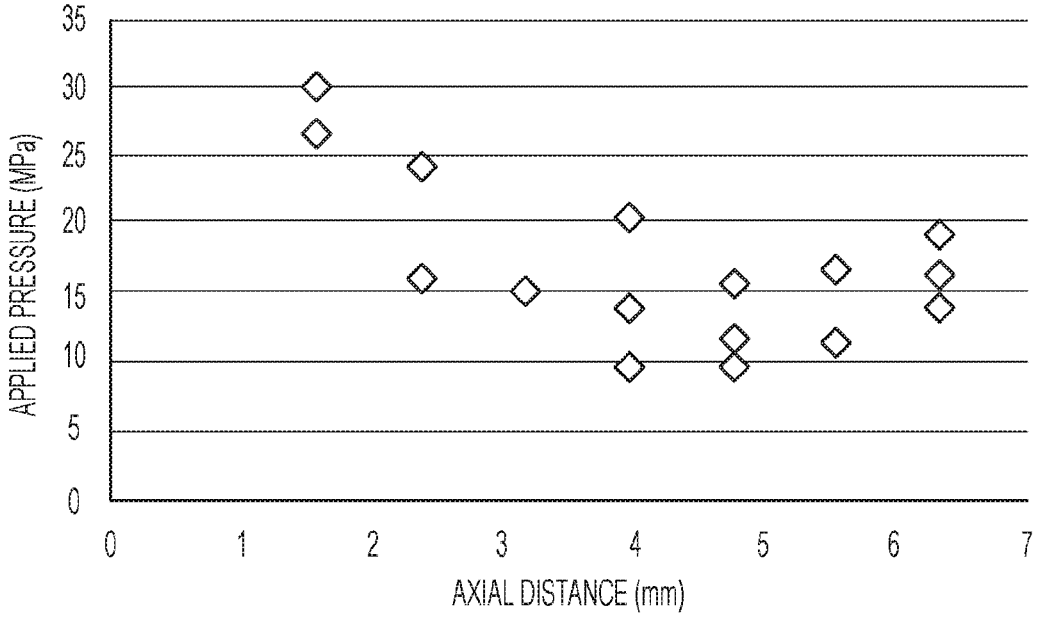
FIG. 6A shows a plot of applied pressure to an edge of a honeycomb body as a function of axial distance between a rib and the honeycomb body.
Figure 6B:
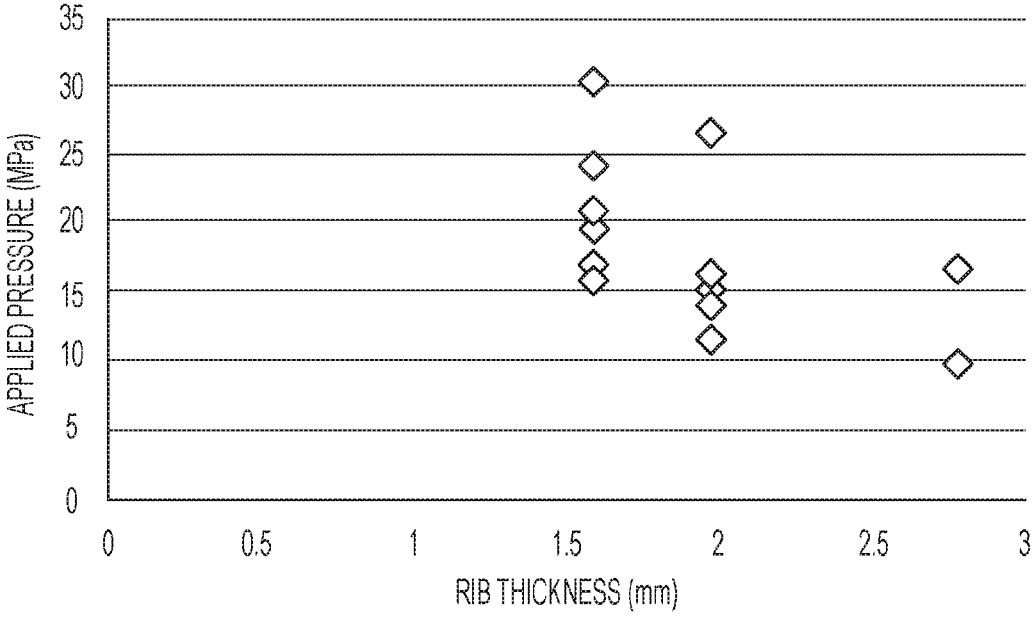
FIG. 6B shows a plot of applied pressure to an edge of a honeycomb body as a function of rib thickness.

FIG. 6A shows a plot of applied pressure to an edge of a honeycomb body as a function of axial distance between a rib and the honeycomb body. FIG. 6B shows a plot of applied pressure to an edge of a honeycomb body as a function of rib thickness. The plots were generated using simulations with a 12.7 mm rib width. Applied pressure at the edges of the honeycomb bodies generally decreases with increasing rib thickness (408), while the axial distance (412) between the rib and the honeycomb body appears to be a consequential parameter with an optimal value of 4 to 5 mm.

Figure 7:
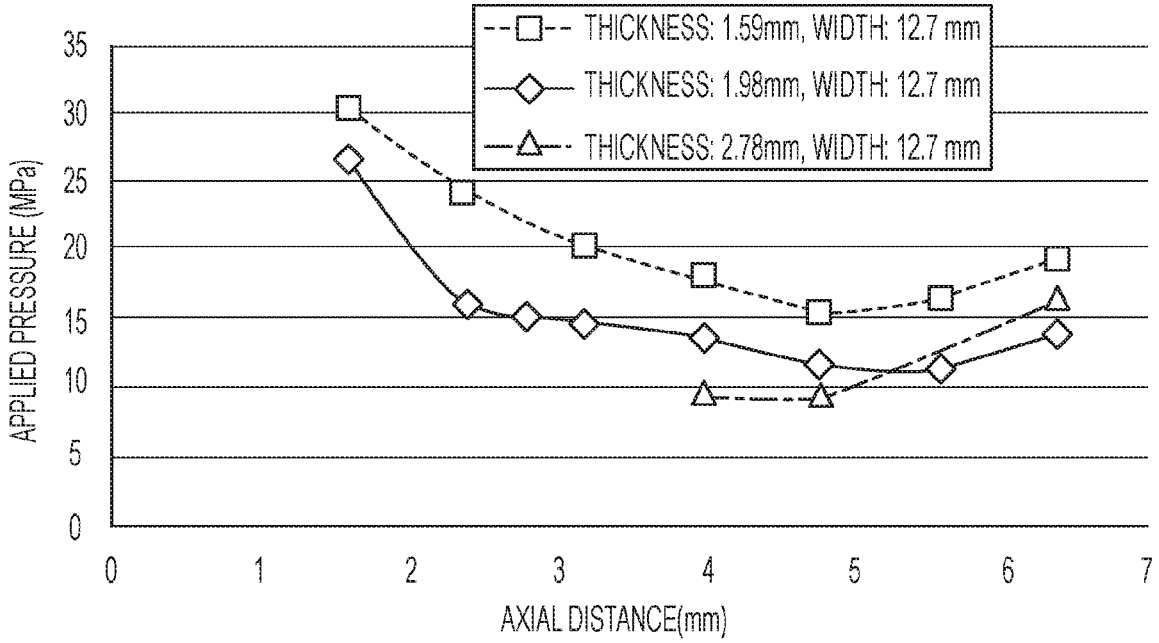
FIG. 7 shows a plot of applied pressure to an edge of a honeycomb body as a function of axial distance between a rib and the honeycomb body for three different rib designs.

FIG. 7 shows a plot of applied pressure to an edge of a honeycomb body as a function of axial distance between a rib and the honeycomb body for three different rib designs. The results are consistent in that the optimal axial distance (412) between the rib and the honeycomb body is approximately 4 to 5 mm. Furthermore, increasing the thickness (412) of the rib decreases the applied pressure at the edges of the honeycomb body.

FIG. 8 shows an alternate rib design where the rib 804 has been moved from an inner surface of the metal layer 402 to an outer surface of the metal layer (e.g., similar to a flange mount). Such a design may be advantageous where an interior retainer ring is not a preferred embodiment (e.g., in the cases where reduced pressure drop is desired). In this embodiment, the thickness 414 of the metal layer 402 is also 1.59 mm.

Figure 9A:
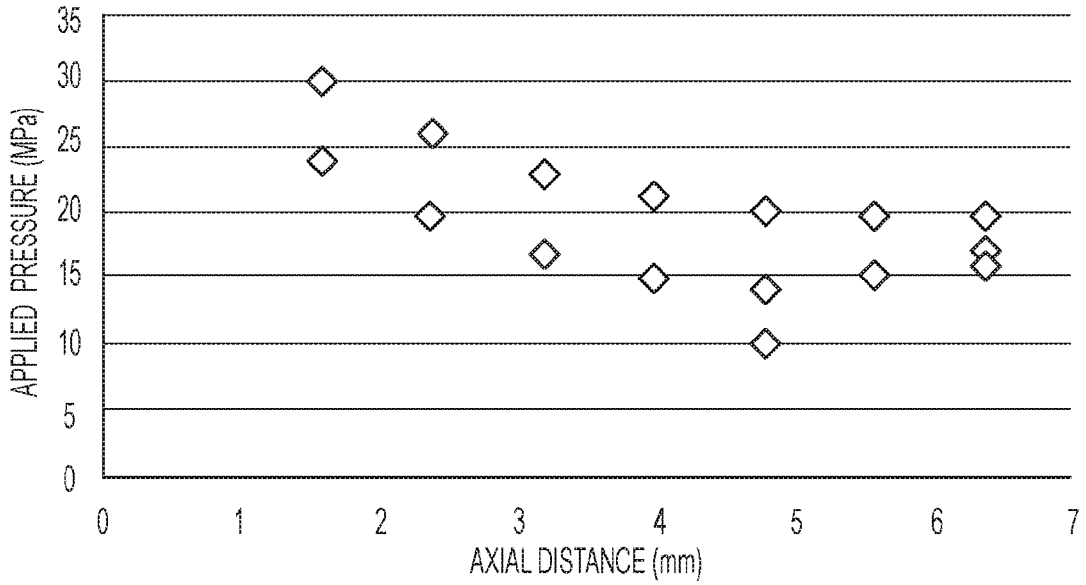
FIG. 9A shows a plot of applied pressure to an edge of a honeycomb body as a function of axial distance between a rib and the honeycomb body for rib designs where a rib is located on an outer surface of a metal layer.
Figure 9B:
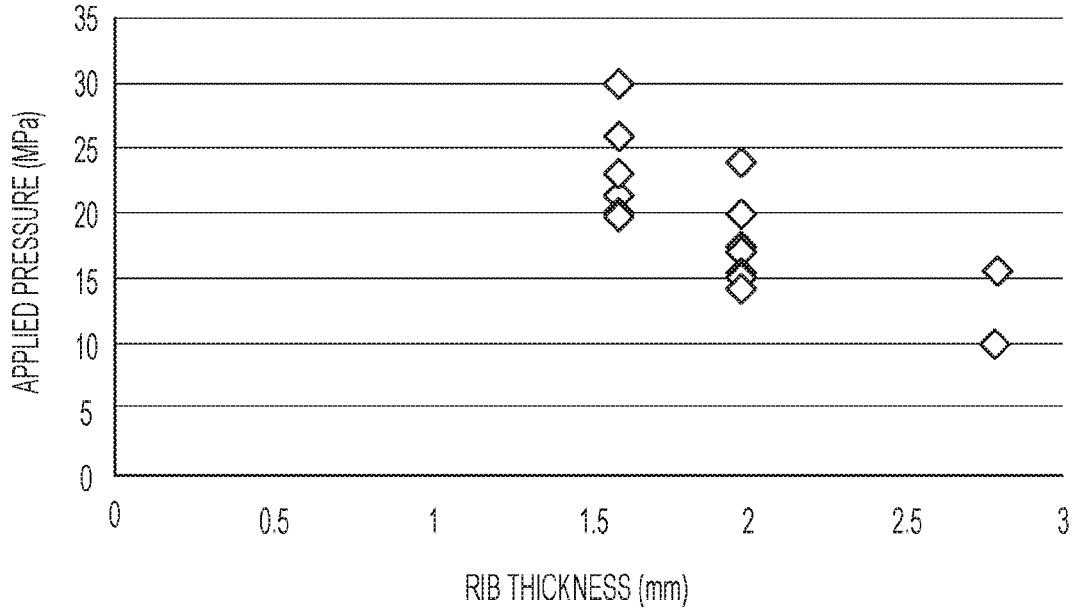
FIG. 9B shows a plot of applied pressure to an edge of a honeycomb body as a function of rib thickness for rib designs where a rib is located on an outer surface of a metal layer.

An analysis of various parameters was completed for the alternate rib design in a similar manner to the analysis performed for the rib design with ribs on an inner surface of the metal layer. FIG. 9A shows a plot of applied pressure to an edge of a honeycomb body as a function of axial distance between a rib and the honeycomb body for rib designs where a rib is located on an outer surface of a metal layer. FIG. 9B shows a plot of applied pressure to an edge of a honeycomb body as a function of rib thickness for rib designs where a rib is located on an outer surface of a metal layer. The plots were generated using simulations with a 12.7 mm rib width. There is a strong correlation (i) between axial distance (412) and applied pressure and (ii) between rib thickness (408) and applied pressure. As rib thickness increases, applied pressure is reduced.

Figure 10:
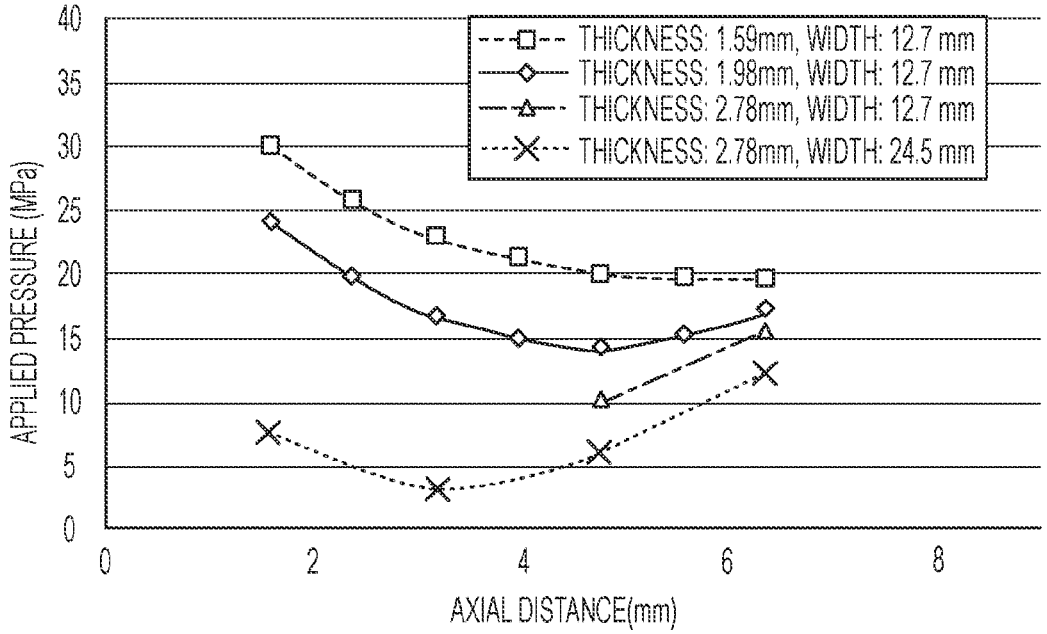
FIG. 10 shows a plot of applied pressure to an edge of a honeycomb body as a function of axial distance between a rib and the honeycomb body for four different rib designs where a rib is located on an outer surface of a metal layer.

FIG. 10 shows a plot of applied pressure to an edge of a honeycomb body as a function of axial distance between a rib and the honeycomb body for four different rib designs where a rib is located on an outer surface of a metal layer. The plot shows that wider ribs performed better than ribs having lesser widths. Also, ribs having wider and thicker dimensions performed the best. This result can again be attributed to the effect of rib dimensions on the moment of inertia. Wider ribs are much more effective at reducing the loading on the edges of the honeycomb body than ribs having lesser widths. The results demonstrate that external ribs located on outer surfaces of the metal layer can be just as effective as internal ribs.

Figure 11:
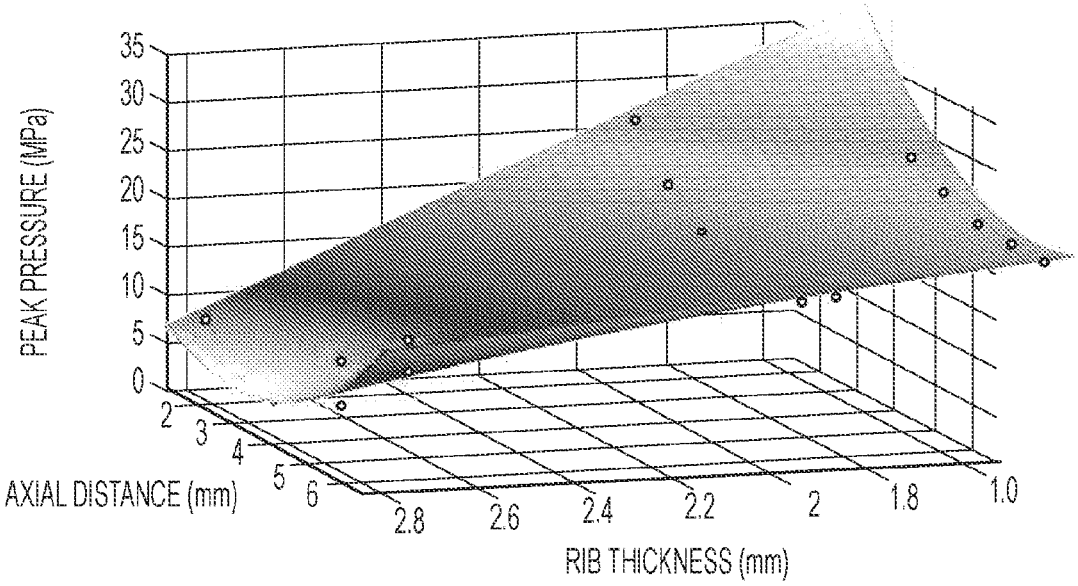
FIG. 11 shows a three-dimensional plot of peak pressure, axial distance between a rib and a honeycomb body, and rib thickness.

FIG. 11 shows a three-dimensional plot of (i) peak applied pressure at the edges of the honeycomb body, (ii) axial distance (412) between the rib and the honeycomb body, and (iii) rib thickness (408). The plot demonstrates that a fit to the response surface can be obtained for the cases simulated. An example fit shows that only two factors are required for the fit. Results and fit quality for the data plotted in FIG. 11 are provided in the following list.

Linear Model:

$$f(x,y)=p00+p10*x+p01*y+p11*x*y+p02*y^2$$

Coefficients (with 95% Confidence Bounds):

p00=82.66 (74.4, 90.93)
p10=−24.79 (−28.34, −21.23)
p01=−14.19 (−16.84, −11.54)
p11=3.115 (2.34, 3.889)
p02=0.8733 (0.6024, 1.144)

Goodness of Fit:

SSE: 25.38
R-square: 0.9704
Adjusted R-square: 0.9625
RMSE: 1.301

Figure 12A:
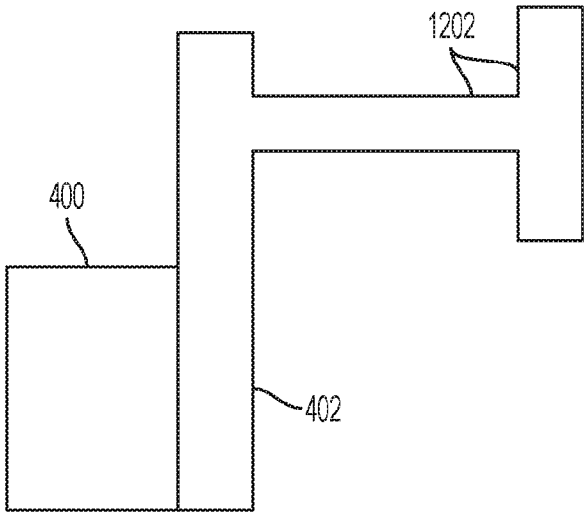
FIG. 12A shows a T-shaped rib design in accordance one embodiment of the present disclosure.
Figure 12B:
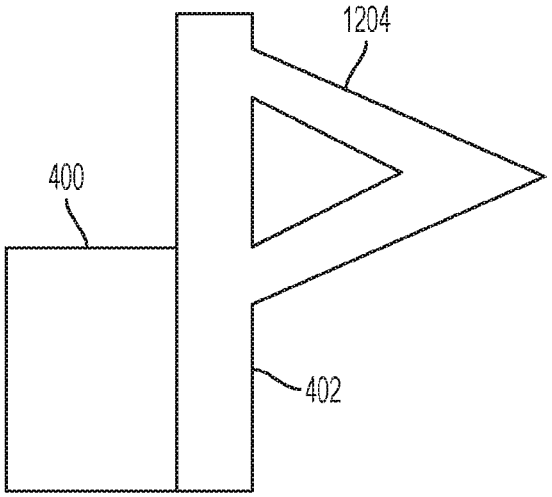
FIG. 12B shows a triangular-shaped rib design in accordance one embodiment of the present disclosure.

The present disclosure is not limited to the rectangular rib design shown in FIGS. 4A, 5, and 8. The rib can also have a more complex form. A more complex form may be more effective than the rectangular rib design, while also consuming less radial space. For instance, a T-shaped rib could be applied to the metal layer. An example of a T-shaped rib 1202 is shown in FIG. 12. In addition, a triangular-shaped rib could also be effective, while advantageously decreasing the size of the rib. An example of a triangular-shaped rib 1204 is shown in FIG. 12.

Figure 13:
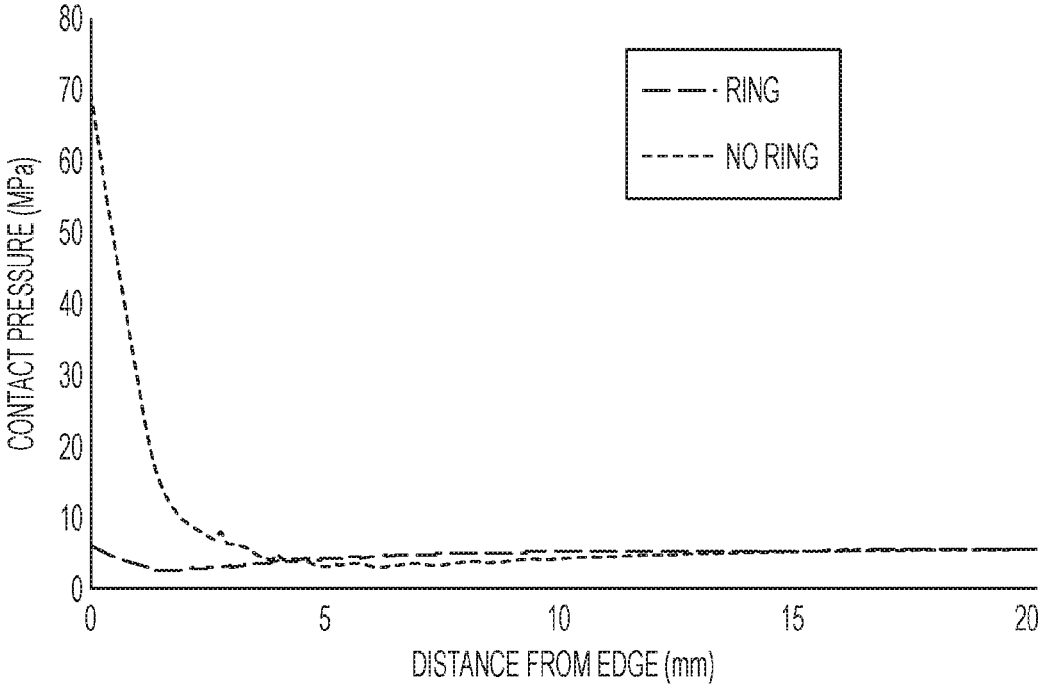
FIG. 13 shows a plot of contact pressure versus distance from an edge of the honeycomb body.

The rib designs described above were analyzed using finite element analysis (FEA) modeling. The modeling shows that the rib designs effectively reduce pressure when compared to a baseline case of a shrink-fit metal layer with no ribs. FIG. 13 shows a plot of contact pressure versus axial distance from an edge of the honeycomb body. The plot shows the contact pressures for a shrink-fit metal layer with and without a rib. When using a rib, the contact pressure on for axial distances adjacent to the honeycomb body can be reduced by a factor of more than 7 (greater than seven times), demonstrating the usefulness of the exemplary embodiments of the disclosure.

Figure 14:
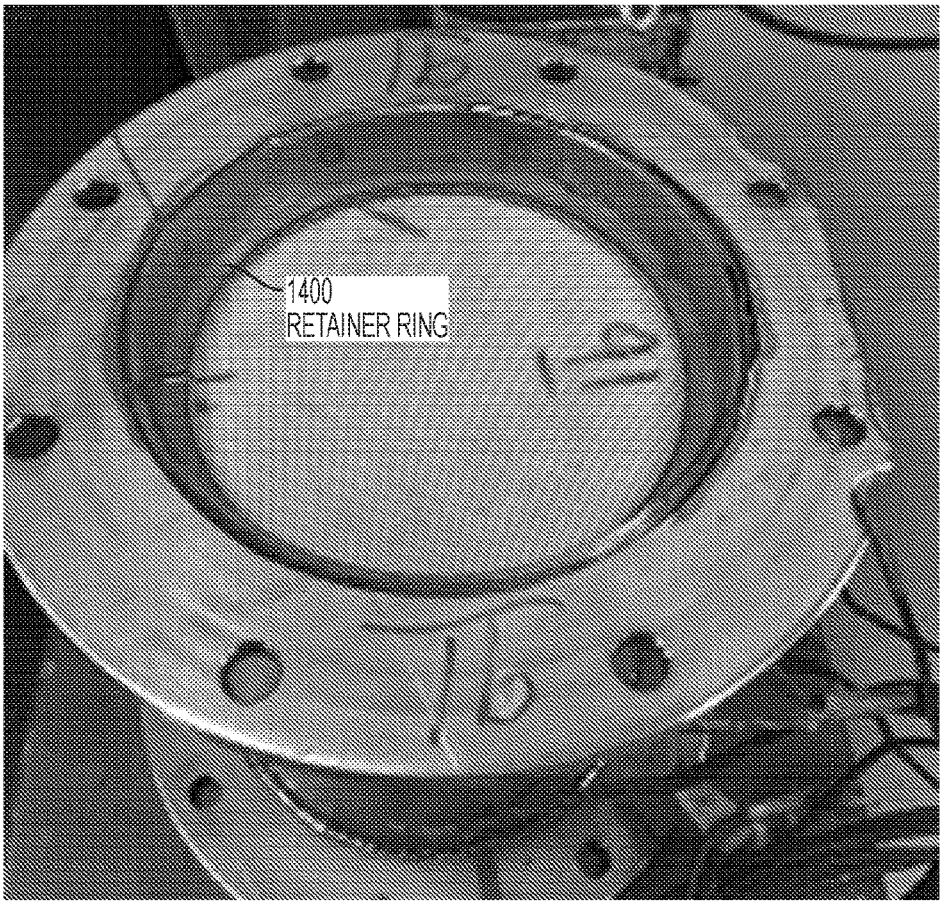
FIG. 14 shows a honeycomb body that survived a shrink-fit process using a pair of ribs in accordance one embodiment of the present disclosure.

The simulations described above were confirmed experimentally. The first experiment was performed by shrink-fitting a honeycomb body using a can without ribs. The first experiment resulted in a cracked honeycomb body due to high pressures, as shown in FIG. 3. The second experiment was performed by shrink-fitting a honeycomb body using a can with a pair of ribs (retainer rings (1400)) at an inlet and outlet of the can. FIG. 14 shows the results of the second experiment. More specifically, FIG. 14 shows a honeycomb body that survived the shrink-fitting process. The ribs described herein are practically implementable and compatible with numerous processes and devices used in production today.

Other exemplary embodiments of the disclosure provide solutions to non-uniformities in the can that can result in point loading of the honeycomb body during the shrink-fitting process and/or during field operation, particularly at the location of a joint, resulting in catastrophic failure of the canned article. Methods for reducing the point loading of shrink-fit canned exhaust articles are disclosed herein. Various embodiments of the methods mitigate the issues of honeycomb body cracking associated with point loading of the body at/near the location of a joint.

Figure 15:
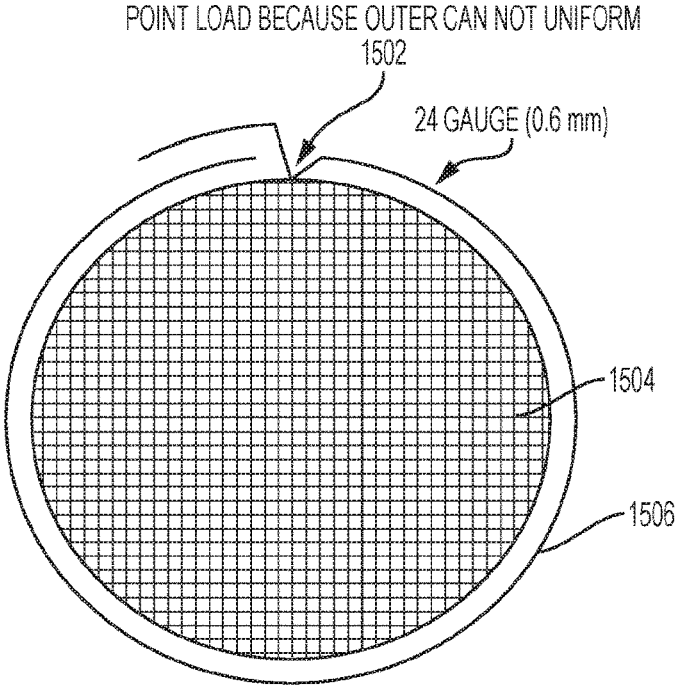
FIG. 15 shows how a metal lap joint can point load a honeycomb body causing early body failure in an arrangement where the body is canned without a mat.
Figure 16:
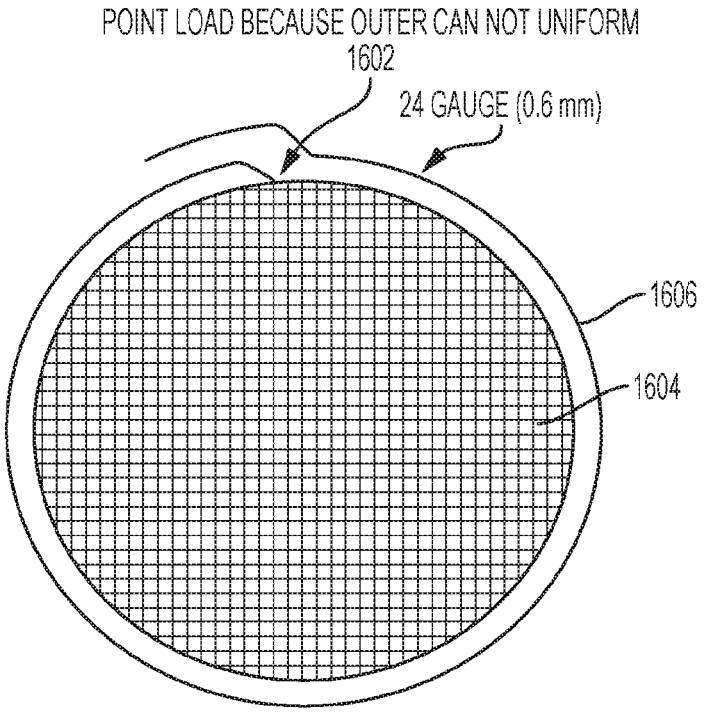
FIG. 16 shows another example of how a metal lap joint can point load the honeycomb body causing early substrate failure.

FIG. 15 illustrates how a metal lap joint 1502 can point load a honeycomb body 1504 causing early body failure in an arrangement where the honeycomb body is canned without a mat. The point load develops because the metal can 1506 is not uniform along its circumference. FIG. 16 shows another example of how a lap joint 1602 can point load the honeycomb body 1604 causing early substrate failure. In this case, again, the point load develops because the metal can 1606 is not uniform along its circumference. In both the examples shown in FIGS. 15 and 16, the metal layers (forming the can) have a 24 gauge thickness (0.6 mm).

Figure 17:
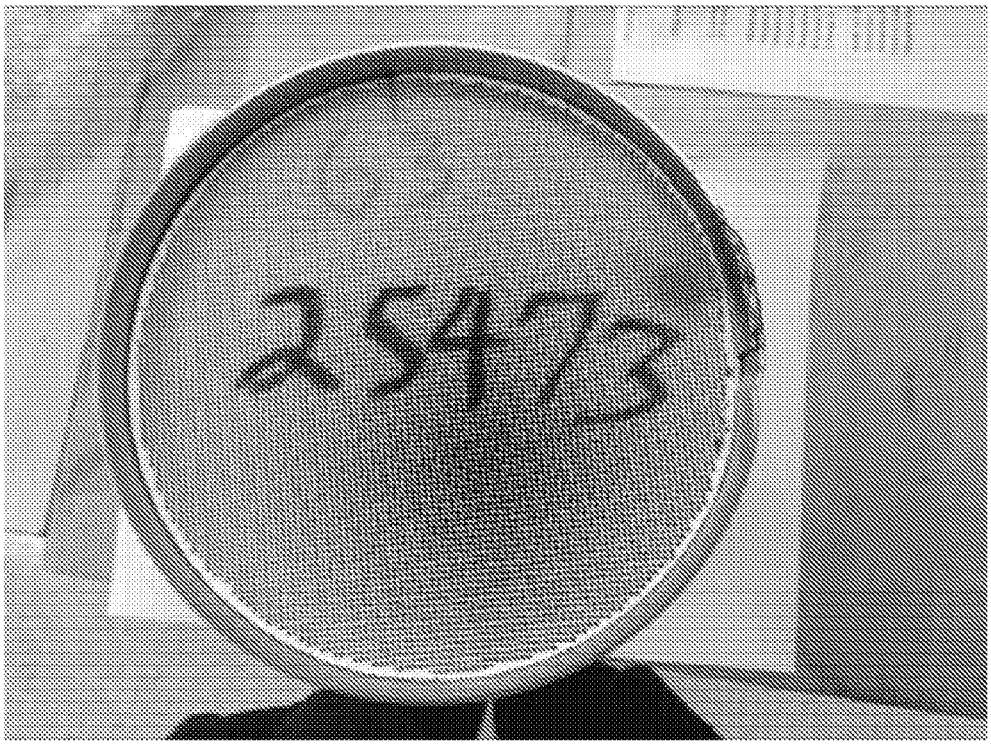
FIG. 17 shows failure of a porous ceramic honeycomb body that was canned using a shrink-fit process.

FIG. 17 shows failure of a porous ceramic honeycomb body that was canned using a shrink-fit process. The porous ceramic honeycomb body was shrink-fit at 300° C. using 16 gauge stainless steel as a metal layer. The body shows stress/initial failure at an overlap joint of the metal layer.

Exemplary embodiments of the present disclosure use thinner, more yielding shim(s) at the location of a joint for reducing the point loading of the honeycomb body. The shim facilitates matless canning of the honeycomb body. In some embodiments, the shim eliminates honeycomb body cracking issues associated with the point loading of the body at/near the location of a joint.

Figure 18:
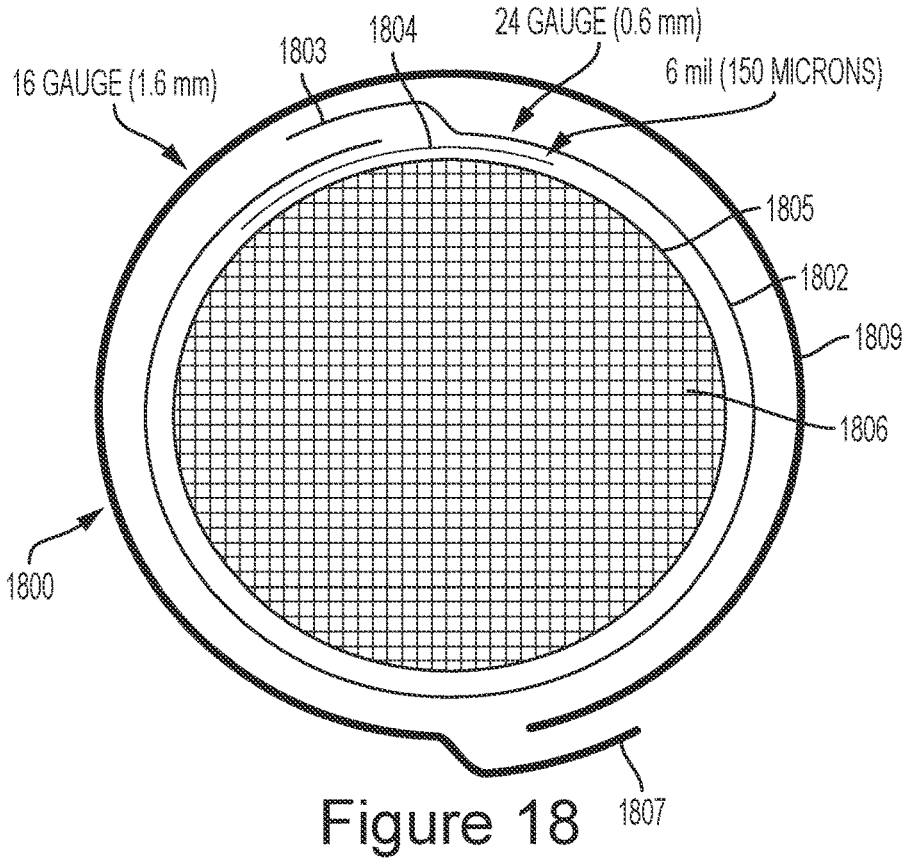
FIG. 18 shows an exhaust gas treatment article with a metal layer that surrounds a porous ceramic honeycomb body in accordance one embodiment of the present disclosure.

FIG. 18 shows an exhaust gas treatment article 1800 with a metal layer 1802 that surrounds a porous ceramic honeycomb body 1806. The metal layer 1802 comprises a metal material, such as steel or stainless steel. Also, the metal layer 1802 can have any form that is capable of being shrink-fit onto the honeycomb body 1806, such as a metal sheet, a metal perforated sheet, or an expanded metal.

Figure 19:
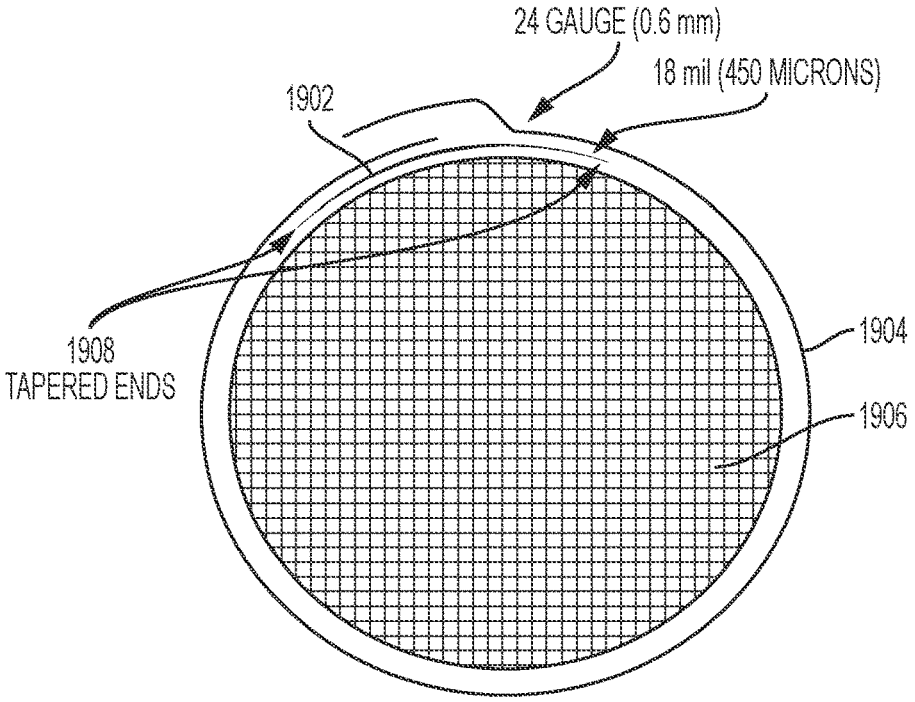
FIG. 19 shows another exhaust gas treatment article with a metal layer that surrounds a porous ceramic honeycomb body in accordance one embodiment of the present disclosure.
Figure 20:
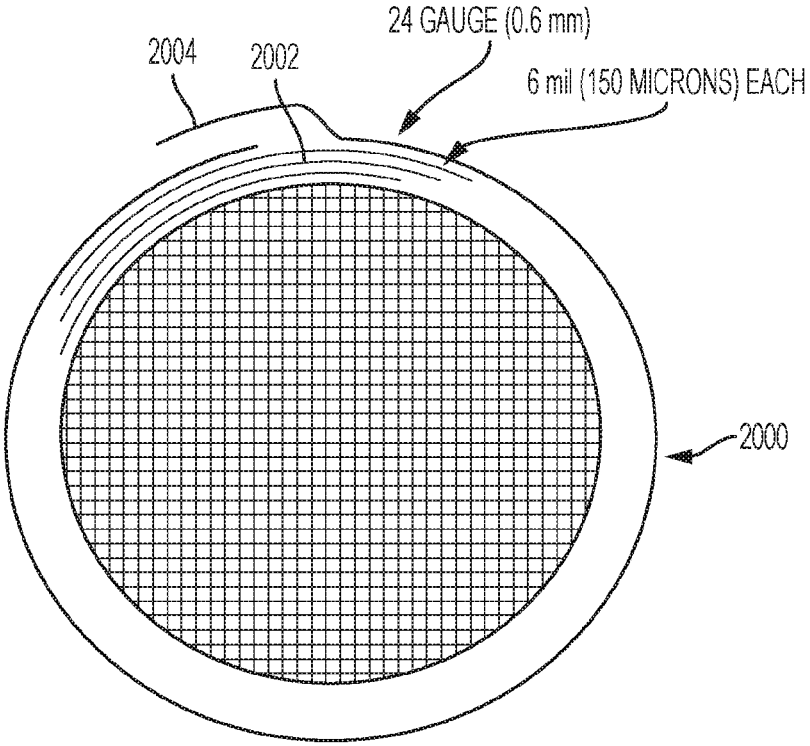
FIG. 20 shows an exhaust gas treatment article that includes multiple shims with ends that are offset from one another in accordance one embodiment of the present disclosure.
Figure 21:
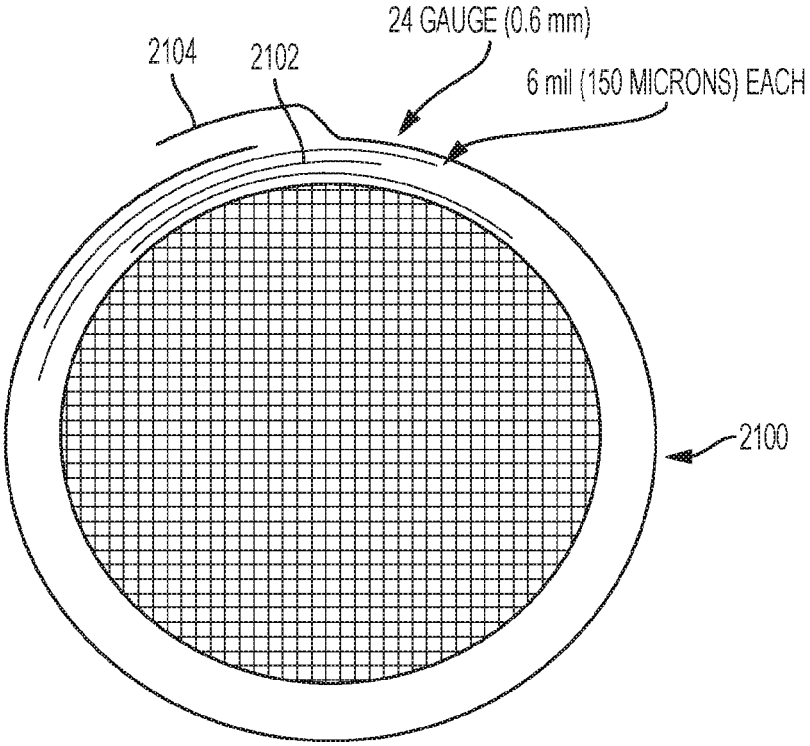
FIG. 21 shows another example of an exhaust treatment article that includes multiple shims with ends that are offset from one another in accordance one embodiment of the present disclosure.

The metal layer 1802 includes a joint 1803 that secures a first portion of the metal layer 1802 (e.g., a first end portion of the metal layer) to a second portion of the metal layer (e.g., a second end portion of the metal layer) in order to form a tube- or sleeve-like structure. In various embodiments, the joint 1803 is created by welding the first portion of the metal layer 1802 and the second portion of the metal layer together to form a welded joint. In some embodiments, the joint extends along the metal layer 1802 in an axial direction (as shown by reference numeral 105 in FIG. 1A). In FIG. 18, the joint is a lap joint. A first end portion of the metal layer 1802 overlaps a second end portion of the metal layer. The first end portion of the metal layer 1802 that overlaps the second end portion of the metal layer includes an offset "step" feature that is used to reduce point loading on the honeycomb body 1806. FIGS. 19, 20, and 21 include lap joints with such step features, as compared to the joint in FIG. 26 which shows a plain lap joint without a step feature.

The exhaust gas treatment article 1800 also includes a shim 1804 that is located under the joint 1803. The shim 1804 is in direct contact with an outer peripheral surface 1805 of the porous ceramic honeycomb body 1806. In some embodiments, the shim comprises a metal material, such as steel or stainless steel. In various embodiments, less than 50% of the outer peripheral surface 1805 of the porous ceramic honeycomb body 1806 is in direct contact with the shim 1804. In further embodiments, less than 25% of the outer peripheral surface 1805 of the porous ceramic honeycomb body 1806 is in direct contact with the shim 1804.

The metal layer 1802 is also in direct contact with at least a portion of the outer peripheral surface 1805 of the porous ceramic honeycomb body 1806. In some embodiments, greater than 50% of the outer peripheral surface 1805 of the porous ceramic honeycomb body 1806 is in direct contact with the metal layer 1802. In further embodiments, greater than 75% of the outer peripheral surface 1805 of the porous ceramic honeycomb body 1806 is in direct contact with the metal layer 1802.

As shown in FIG. 18, the exhaust gas treatment article 1800 does not include a mat between the metal layer 1802 and the outer peripheral surface 1805 of the porous ceramic honeycomb body 1806. Instead, the shim 1804 and the metal layer 1802 are in direct contact with the outer peripheral surface 1805 of the porous ceramic honeycomb body 1806.

The exhaust gas treatment article 1800 may also include an optional second metal layer 1809 that is disposed on top of the metal layer 1802 and that surrounds the metal layer. In FIG. 18, the metal layer 1802 and the second metal layer 1809 form the can. The metal layer 1802 may be referred to as an "inner can," while the second metal layer 1809 may be referred to as an "outer can" or an "over-can." The second layer 1809 may also include a joint, such as a lap joint 1807. In some embodiments, the joint 1807 can be offset from the metal layer joint 1803 to lower stress on the honeycomb body 1806. A shim, such as one described in the present disclosure, can be used under the second metal layer joint 1807 (and on top of the metal layer 1802) to reduce pressure points on the honeycomb body 1806.

In some embodiments, the metal layer 1802 is shrink-fit onto the honeycomb body 1806 such that the metal layer applies a radial compressive force to the honeycomb body thereby securing the body within the metal layer. The metal layer and the honeycomb body can then be secured to the second layer or to an exhaust system (e.g., using a welding process).

In other embodiments, the second metal layer 1809 is shrink-fit onto the metal layer 1802 and the honeycomb body 1806 such that the second metal layer applies a radial compressive force to the metal layer and the honeycomb body, thereby securing both the metal layer and the body within the second metal layer. In this arrangement the metal layer 1802 can serve as a stress distributor.

Although the second metal layer 1809 is not shown in FIGS. 19-25, the second metal layer may also be used in the embodiments shown in these Figures.

In illustrative embodiments, the metal shim 1804 is thinner than the metal layer 1802. In FIG. 18, the metal layer 1802 is comprised of 24 gauge (0.6 mm) stainless steel. The shim 1804 is comprised of 6 mil (150 microns) thick stainless steel. The second metal layer 1801 is comprised of 16 gauge (1.6 mm) thick stainless steel. Thus, the thinner shim 1804 is disposed beneath the joint 1803 and between the honeycomb body 1806 and the thicker metal layer 1802 of the can. The use of the thinner shim 1804 results in reduced point loading on the body 1806. The thinner shim 1804 also helps in reducing the stresses induced in the body 1806 as the body yields during the shrink-fitting process. In some embodiments, the thickness of the shim 1804 is less than half the thickness of the metal layer 1802. In some other embodiments, the thickness of the shim 1804 is less than a third the thickness of the metal layer 1802. In still other embodiments, the thickness of the shim 1804 is less than one-fifth the thickness of the metal can layer 1802. In still other embodiments, the thickness of the shim 1804 is less than one-tenth of the thickness of the metal layer 1802.

For cases where the thickness of the shim is smaller than the thickness of the metal layer, but still too think (for example, FIG. 19 illustrates a configuration having a shim thickness 1902 of 18 mils (~450 microns) with a 24 gauge metal layer thickness 1904 (0.6 mm)), the point load can still be large enough to negatively impact the integrity of the honeycomb body 1906. Thus, in some embodiments, the ends 1908 of the shim 1902 are tapered (e.g., grinded and/or feathered) to reduce the magnitude of the point loading stresses.

Figure 22:
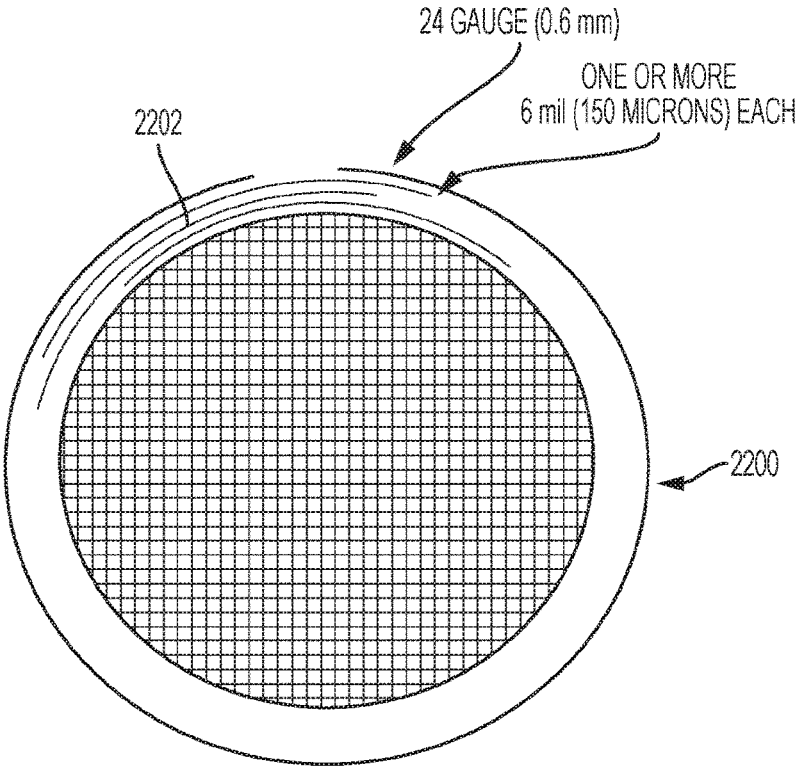
FIG. 22 shows an exhaust gas treatment article that includes multiple shims and no overlap joint in accordance one embodiment of the present disclosure.
Figure 23:
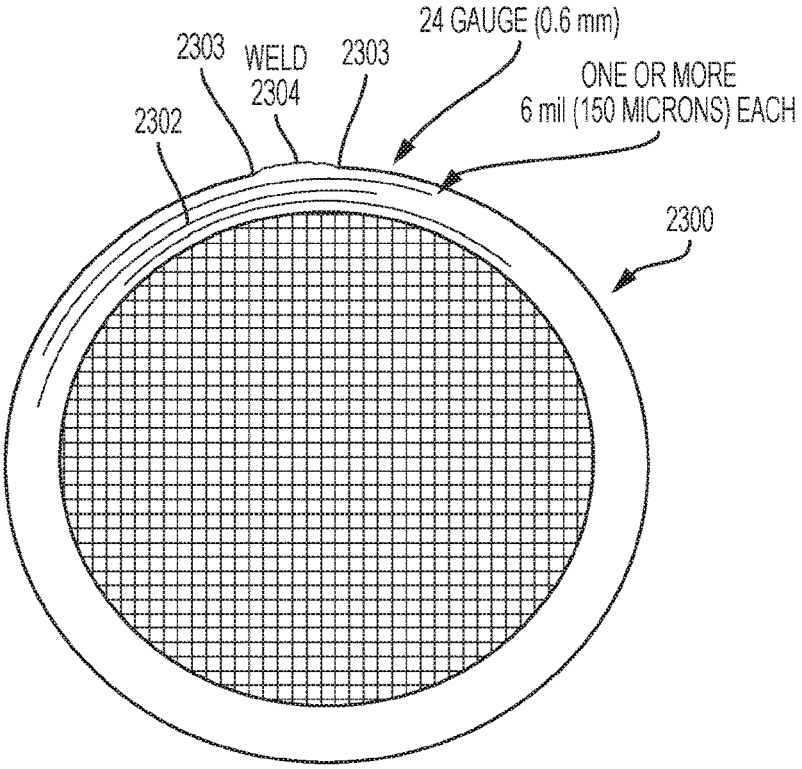
FIG. 23 shows an exhaust gas treatment article that includes multiple shims and a welded joint in accordance one embodiment of the present disclosure.

In other embodiments, the exhaust gas treatment article includes multiple shims. The ends of the shims may be offset from one another (e.g., staggered) in their positioning to prevent point loading caused by the ends of the shims. In other words, the ends of the shims are not aligned to prevent point loading. FIG. 20 shows an exhaust treatment article 2000 that includes multiple shims 2002 with ends that are offset from one another under a lap joint with a step feature 2004. FIG. 21 shows another example of an exhaust treatment article 2100 that includes multiple shims 2104 with ends that are offset from one another under a lap joint with a step feature 2104. FIG. 22 shows an exhaust treatment article 2200 that includes multiple shims 2202 and a butt joint. FIG. 23 shows an exhaust treatment article 2300 that includes multiple shims 2302 and a welded butt joint 2304 that secures end portions of the metal layer 2303.

Figure 24:
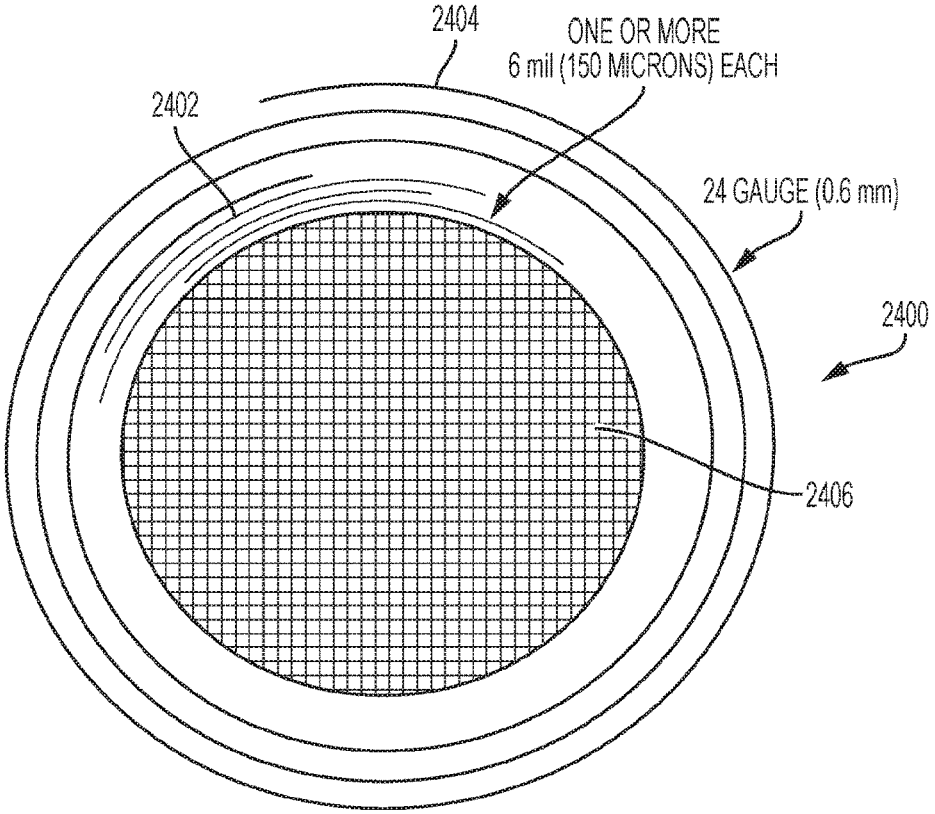
FIG. 24 shows an exhaust gas treatment article with a shim and a metal layer that extends around a circumference of a porous ceramic honeycomb body multiple times in accordance one embodiment of the present disclosure.

In some embodiments, the exhaust gas treatment article includes a metal layer that extends around the circumference of the honeycomb body multiple times such that the metal layer overlaps multiple times (e.g., 2, 3, or 4 times) to form a "spiral" or a "jelly-roll" structure. FIG. 24 shows an exhaust gas treatment article 2400 with multiple shims 2402 and a 24 gauge (0.6 mm) metal layer 2404 that extends around the circumference of a honeycomb body 2406 multiple times.

Figure 25:
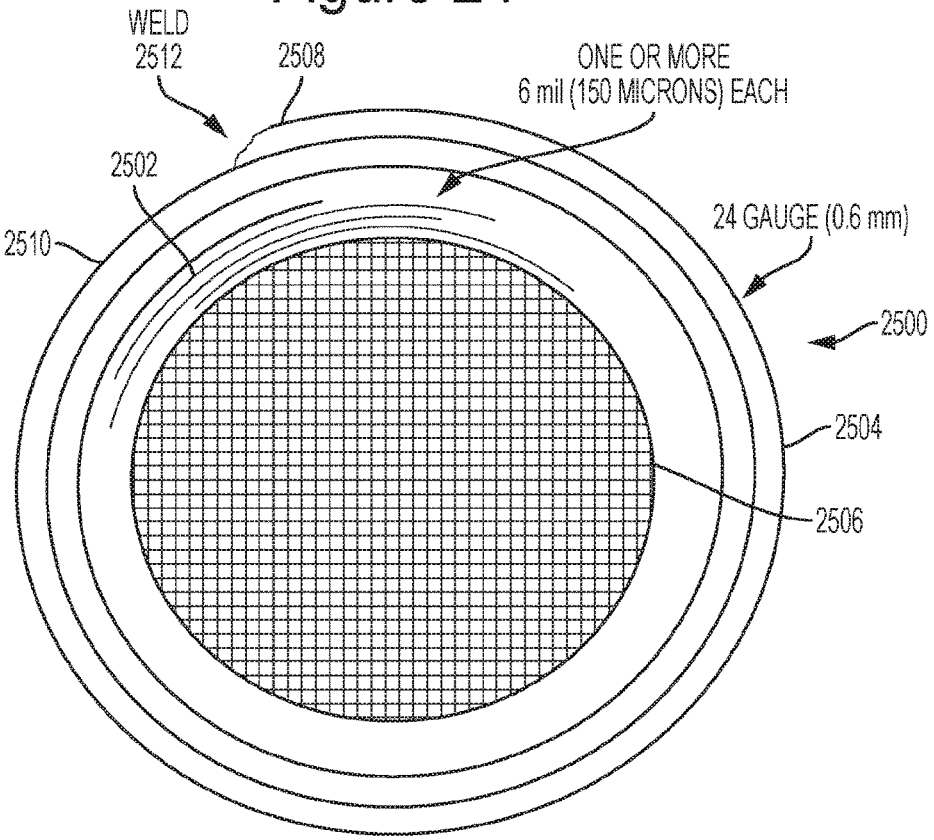
FIG. 25 shows another example of an exhaust gas treatment article with a shim and a metal layer that extends around the circumference of a honeycomb body multiple times in accordance one embodiment of the present disclosure.

In some the embodiments, an outer end of the metal layer is welded to an outer surface of the metal layer. FIG. 25 shows an exhaust gas treatment article 2500 with multiple shims 2502 and a 24 gauge (0.6 mm) metal layer 2504 that extends around the circumference of a honeycomb body 2506 multiple times. An outer end portion 2508 of the metal layer 2504 is welded to an outer surface 2510 of the metal layer at a welded joint 2512.

Figure 26:
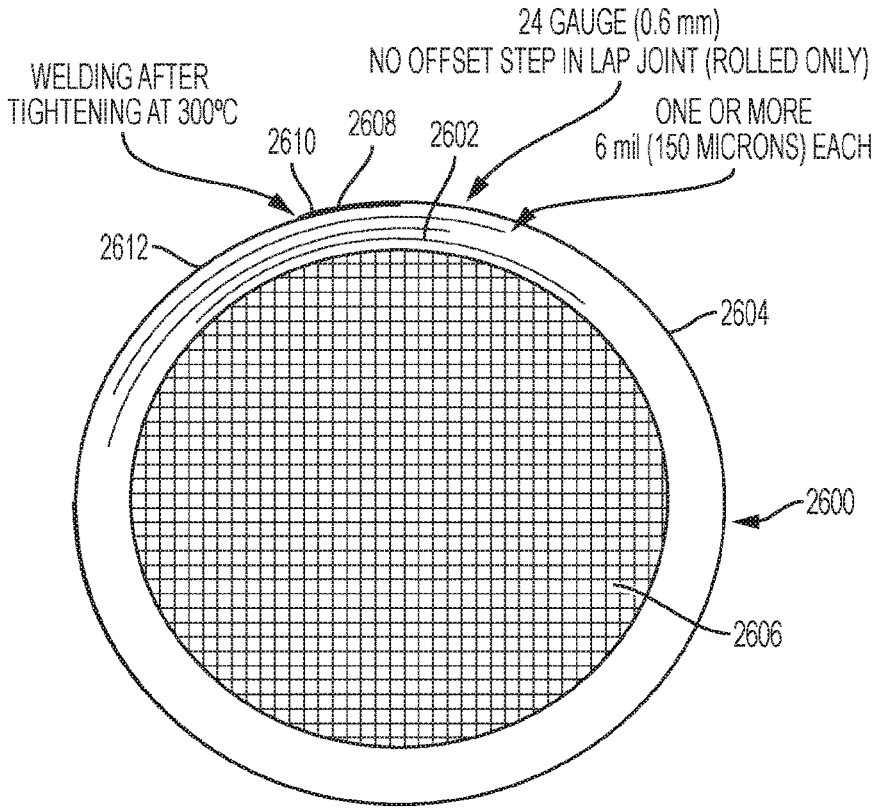
FIG. 26 shows an exhaust gas treatment article with a shim and a metal layer that extends around a honeycomb body such that that one end portion of the metal layer overlaps the other end portion in accordance one embodiment of the present disclosure.

In some embodiments, the exhaust gas treatment article includes a metal layer that includes a plain lap joint. FIG. 26 shows an exhaust gas treatment article 2600 with multiple shims 2602 and a 24 gauge (0.6 mm) metal layer 2604 that extends around a honeycomb body 2606 such that that one end portion 2608 of the metal layer overlaps the other end portion 2610. The end portion 2608 of the metal layer 2604 is welded to an outer surface 2612 of the metal layer to form a welded plain lap joint without a step feature.

In various embodiments, the number of shims used is greater than 1 and less than 5. In some embodiments, the thickness of each individual shim is less than a third of the thickness of the metal layer. In other embodiments, the thickness of each individual shim is less than one-fifth the thickness of the metal layer. In still other embodiments, the thickness of the each individual shim is less than one-tenth the thickness of the metal layer. The embodiments shown in FIGS. 20-26 include one or more shims of 6 mil thickness (150 microns). In various embodiments, an individual shim has a thickness in a range between 25 microns and 400 microns, while the total thickness of all the shims together is in a range between 100 microns and 800 microns.

Figure 27A:
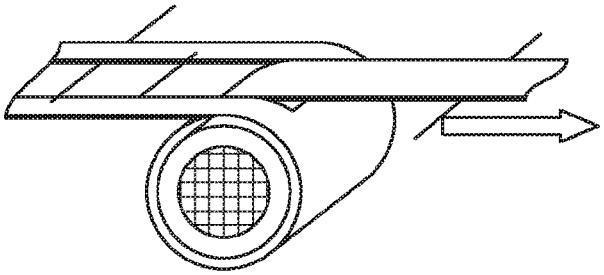
FIG. 27A shows a schematic of a tourniquet testing set up.
Figure 27B:
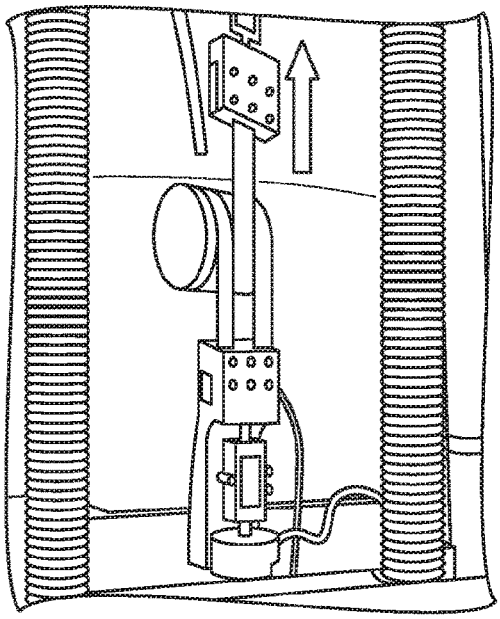
FIG. 27B shows a photograph of a tourniquet testing set up with an exhaust gas treatment article placed within the set up.

The impact of the shim on reduction of point loading in a region adjacent to a joint was studied in loading experiments. The loading experiments were performed using a tourniquet testing set up, as shown in FIGS. 27A and 27B. FIG. 27A shows a schematic of a tourniquet testing set up. FIG. 27B is a photograph of a tourniquet testing set up with an exhaust gas treatment article placed within the set up.

Exhaust gas treatment article samples were wrapped with a strap and placed on a tourniquet rig. The exhaust gas treatment article samples were placed such that the joints within the metal layers were positioned away from the tourniquet overlap. The strap was then subjected to pulling force until the honeycomb body within the article underwent catastrophic structural failure. The load at which the honeycomb body failure occurred for different experiments is shown in Table 1. Comparative examples 1 and 2 included welded joints without shims, while Examples 1-6 included welded joints with shims.

TABLE 1

| Sample # | Substrate mass (g) | Sample description | Canning temp, ° C. | Can material |
|---|---|---|---|---|
| Comparative Example 1 | 908.5 | Bare substrate. | Room temp | 409 stainless steel |

TABLE 1-continued

| | | | | |
|---|---|---|---|---|
| Comparative Example 2 | 916 | Bare substrate. | Room temp | 409 stainless steel |
| 1 | 921.9 | Seam weld, w/ lap and shim. | 300 | 409 stainless steel |
| 2 | 918.1 | Seam weld, w/ lap and shim | 300 | 409 stainless steel |
| 3 | 901.9 | Seam weld, w/ lap and shim | 300 | 409 stainless steel |
| 4 | 947.7 | Seam weld, without step in lap. Includes shim. | 300 | 409 stainless steel |
| 5 | 947.3 | Just overlap, without step in lap. Includes shim. | RT | 409 stainless steel |
| 6 | 941.5 | Just butted weld joint. Includes shim. | RT | 409 stainless steel |

| Sample # | Can thickness and material, gauge | Dimensions (diameter in × length in) | Geometry (CPSI/ wall thickness in mils) | Closing force before cracking substrate, lbs |
|---|---|---|---|---|
| Comparative Example 1 | 16 outer, 24 inner | 5.66 in × 6 in | 300/5 | 710 |
| Comparative Example 2 | 16 outer, 24 inner | 5.66 in × 6 in | 300/5 | 2200 |
| 1 | 16 outer, 24 inner | 5.66 in × 6 in | 300/5 | 5200 |
| 2 | 16 outer, 24 inner | 5.66 in × 6 in | 300/5 | 4900 |
| 3 | 16 outer, 24 inner | 5.66 in × 6 in | 300/5 | 5600 |
| 4 | 16 outer, 24 inner | 5.66 in × 6 in | 300/5 | 4000 (no cracks) |
| 5 | 16 outer, 24 inner | 5.66 in × 6 in | 300/5 | 4000 (no cracks) |
| 6 | 16 outer, 24 inner | 5.66 in × 6 in | 300/5 | 4000 (no cracks) |

It is observed that, in comparative examples where the honeycomb bodies were crushed in the tourniquet experiments (without use of any mat or shim), the maximum force was between 700-2200 lbs before the honeycomb bodies failed. With the use of a shim at the location of the weld joint (for configurations comprising both overlap and no overlap lap joints), the peak force was observed to increase to between 4900-5600 lbs. Thus, these experiments demonstrate that using a shim under the weld joints reduces point loading of the honeycomb bodies.

Various embodiments of the present disclosure are also directed to a method for manufacturing an exhaust gas treatment article. The method includes shrink-fitting a metal layer including a joint onto a shim and the porous ceramic honeycomb article such that (i) the metal layer surrounds the porous ceramic honeycomb body, (ii) the shim is located under the joint, and (iii) the shim is located between the metal layer and the porous ceramic honeycomb body. Examples of such an article arrangement are shown in FIGS. 18 through 26.

In various embodiments, a mat is not included between the metal layer and the outer peripheral surface of the porous ceramic honeycomb body. Instead, the metal layer is in direct contact with a portion of the outer peripheral surface of the porous ceramic honeycomb body. Also, the shim may be in direct contact with a portion of the outer peripheral surface of the porous ceramic honeycomb body.

The method may further include joining a first portion of the metal layer to a second portion of the metal layer to form the joint. The first portion and second portion can be joined by welding the portions together along an axial direction. In one example, the end portions of the metal layer are joined as shown in FIG. 23. In another example an end portion of the metal layer is joined to an outer surface of the metal layer as shown in FIGS. 25 and 26.

The shrink-fitting process may be performed a number of different ways. For example, in one embodiment, the shrink-fitting process involves heating the metal layer to a high temperature that is above a maximum temperature to be experienced by the outer peripheral surface of the porous ceramic honeycomb body during operation (e.g., greater than or equal to 200° C. or greater than or equal to 300° C.). The metal layer can be heated using, for example, a furnace. After heating to high temperature, the metal layer is removed from the furnace. The shim and honeycomb body are placed on the metal layer. The metal layer is tightened around the honeycomb body and joined while at high temperature. Clamps can be used to hold end portions of the metal layer in place as they are being joined. As the metal layer cools to room temperature, the metal layer shrinks so that the shim and the honeycomb body are secured within the metal layer.

In another embodiment, the metal layer is deformed and joined before the metal layer is heated to high temperature. Once the metal layer is deformed and joined to form a sleeve- or tube-like structure, the metal layer is heated to high temperature in a furnace. After reaching high temperature, the metal layer is removed from the furnace and the shim and honeycomb body are placed inside the sleeve- or tube-like structure. As the metal layer cools to room temperature, the metal layer shrinks so that the shim and the honeycomb body are secured within the metal layer.

In yet another embodiment, the metal layer, the honeycomb body, and the shim are heated to high temperature together. After the components are removed from the furnace, the metal layer is tightened around the honeycomb body and joined while at high temperature. As the components cool to room temperature, the metal layer shrinks so that the shim and the honeycomb body are secured within the metal layer. The honeycomb body has a much smaller coefficient of thermal expansion than the metal layer and, therefore, will not shrink as much as the metal layer upon cooling.

It will be apparent to those skilled in the art that various modifications and variations can be made in the present disclosure without departing from the spirit or scope of the disclosure. Thus, it is intended that the appended claims cover the modifications and variations of this disclosure provided they come within the scope of the appended claims and their equivalents.

The invention claimed is:

1. An exhaust gas treatment article comprising:

a porous ceramic honeycomb body, comprising:

a plurality of channel walls defining cell channels that extend in an axial direction between a first end face and a second end face of the porous ceramic honeycomb body, and an outer peripheral surface that extends in the axial direction between the first end face and the second end face; and a can comprising a metal layer that surrounds the porous ceramic honeycomb body and that is in direct contact with at least a portion of the outer peripheral surface of the porous ceramic honeycomb body, wherein the metal layer includes a joint; and a shim that is located under the joint and that is in direct contact with at least a portion of the outer peripheral surface of the porous ceramic honeycomb body.

2. The exhaust gas treatment article of claim 1, wherein the article does not include a mat between the metal layer and the outer peripheral surface of the porous ceramic honeycomb body.

3. The exhaust gas treatment article of claim 1, wherein the joint is a welded joint.

4. The exhaust gas treatment article of claim 1, wherein the joint extends in the axial direction.

5. The exhaust gas treatment article of claim 1, wherein the shim comprises a metal material.

6. The exhaust gas treatment article of claim 1, wherein the shim includes at least one tapered end.

7. The exhaust gas treatment article of claim 1, wherein the shim includes a plurality of shims comprising ends.

8. The exhaust gas treatment article of claim 7, wherein at least one of the ends of two shims of the plurality of shims are offset from one another.

9. The exhaust gas treatment article of claim 1, further comprising a pair of ribs located on the metal layer and that extend around a circumference of the metal layer.

10. The exhaust gas treatment article of claim 9, wherein the pair of ribs is located on an outer surface of the metal layer.

11. The exhaust gas treatment article of claim 9, wherein the pair of ribs are located on an inner surface of the metal layer.

12. The exhaust gas treatment article of claim 9, wherein the pair of ribs are located on portions of the metal layer that are spaced from the porous ceramic honeycomb body with respect to the axial direction.

13. The exhaust gas treatment article of claim 1, wherein greater than 50% of the outer peripheral surface of the porous ceramic honeycomb body is in direct contact with the metal layer.

14. The exhaust gas treatment article of claim 1, wherein the metal layer is shrink-fit to the porous ceramic honeycomb body and applies a compressive radial force to the outer peripheral surface of the porous ceramic honeycomb body.

15. A method of manufacturing an exhaust gas treatment article comprising a porous ceramic honeycomb body with (i) a plurality of channel walls defining cell channels that extend in an axial direction between first and second end faces and (ii) an outer peripheral surface that extends in the axial direction between first and second end faces, the method comprising:

canning the ceramic honeycomb body in a can by shrink-fitting a metal layer of the can comprising a joint onto a shim and the porous ceramic honeycomb article such that (i) the metal layer surrounds the porous ceramic honeycomb body and the metal layer is in direct contact with a portion of the outer peripheral surface of the porous ceramic honeycomb body, (ii) the shim is located under the joint, and (iii) the shim is located between the metal layer and the porous ceramic honeycomb body.

16. The method of claim 15, further comprising:

joining a first portion of the metal layer to a second portion of the metal layer to form the joint.

17. The method of claim 15, wherein shrink-fitting the metal layer onto the shim and the porous ceramic honeycomb article comprises:

heating the metal layer to a temperature greater than or equal to 200° C.

18. The method of claim 17, wherein shrink-fitting the metal layer onto the shim and the porous ceramic honeycomb article comprises:

tightening the metal layer around the honeycomb body while the metal layer has a temperature greater than or equal to about 200° C.

19. The method of claim 17, wherein shrink-fitting the metal layer onto the shim and the porous ceramic honeycomb article comprises:

allowing the metal layer to cool while the shim and porous ceramic honeycomb body are surrounded by the metal layer.

* * * * *